US012098049B2

(12) United States Patent
Ota et al.

(10) Patent No.: US 12,098,049 B2
(45) Date of Patent: Sep. 24, 2024

(54) MEDIUM PROCESSING APPARATUS AND IMAGE FORMING SYSTEM INCORPORATING SAME

(71) Applicants: Kazuki Ota, Kanagawa (JP); Yohei Yamazaki, Kanagawa (JP); Yuji Miyachi, Kanagawa (JP); Yusuke Hirono, Kanagawa (JP); Yuta Yanai, Kanagawa (JP); Yuji Susaki, Kanagawa (JP); Masanobu Kimata, Kanagawa (JP)

(72) Inventors: Kazuki Ota, Kanagawa (JP); Yohei Yamazaki, Kanagawa (JP); Yuji Miyachi, Kanagawa (JP); Yusuke Hirono, Kanagawa (JP); Yuta Yanai, Kanagawa (JP); Yuji Susaki, Kanagawa (JP); Masanobu Kimata, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 18/300,766

(22) Filed: Apr. 14, 2023

(65) Prior Publication Data

US 2023/0331507 A1 Oct. 19, 2023

(30) Foreign Application Priority Data

Apr. 19, 2022 (JP) ..... 2022-068874

(51) Int. Cl.
*B65H 37/04* (2006.01)
*B65H 39/10* (2006.01)

(52) U.S. Cl.
CPC ..... *B65H 37/04* (2013.01); *B65H 39/10* (2013.01); *B65H 2301/1635* (2013.01);
(Continued)

(58) Field of Classification Search
CPC .... B54H 2408/1223; B65H 2301/1635; B65H 2408/1222; B65H 2801/27; B65H 39/10;
(Continued)

(56) References Cited

U.S. PATENT DOCUMENTS

2007/0138730 A1* 6/2007 Tsutsui ..... B65H 37/04 270/58.09
2007/0176357 A1 8/2007 Horio et al.
(Continued)

FOREIGN PATENT DOCUMENTS

JP 2013-216492 10/2013

*Primary Examiner* — Jennifer Bahls
(74) *Attorney, Agent, or Firm* — IPUSA, PLLC

(57) ABSTRACT

A medium processing apparatus includes a conveyor, a tray, a binder, a mover, and a switcher. The switcher includes a first passage, a second passage, and a movable wall. The movable wall guides a guided portion of the binder to the second passage when the guided portion moving along the first passage from an end side to a center side contacts the movable wall; causes the guided portion to pass when the guided portion moving along the second passage from the end side to the center side contacts the movable wall; guides the guided portion to the first passage when the guided portion moving along the second passage from the center side to the end side contacts the movable wall; and causes the guided portion to pass when the guided portion moving along the first passage from the center side to the end side contacts the movable wall.

9 Claims, 20 Drawing Sheets

(52) U.S. Cl.
CPC ..... *B65H 2301/51611* (2013.01); *B65H 2403/40* (2013.01); *B65H 2408/1223* (2013.01); *B65H 2801/27* (2013.01)

(58) Field of Classification Search
CPC ..... B65H 37/05; B65H 2403/40; B65H 2301/51611
See application file for complete search history.

(56) References Cited

U.S. PATENT DOCUMENTS

| | | | | |
|---|---|---|---|---|
| 2009/0129840 | A1 | 5/2009 | Takekawa et al. | |
| 2010/0252981 | A1 | 10/2010 | Kimata et al. | |
| 2011/0190109 | A1 | 8/2011 | Kimata | |
| 2011/0221125 | A1 | 9/2011 | Kimata | |
| 2013/0270761 | A1* | 10/2013 | Kimata | B41L 43/12 270/58.08 |
| 2016/0355364 | A1 | 12/2016 | Shibata et al. | |
| 2018/0111285 | A1* | 4/2018 | Baek | B65H 37/04 |
| 2020/0101688 | A1* | 4/2020 | Takahashi | B65H 31/3081 |
| 2020/0172368 | A1 | 6/2020 | Susaki et al. | |
| 2020/0231399 | A1 | 7/2020 | Shibata et al. | |
| 2022/0371849 | A1 | 11/2022 | Susaki | |
| 2022/0380165 | A1 | 12/2022 | Yanai | |

* cited by examiner

MEDIUM PROCESSING APPARATUS AND IMAGE FORMING SYSTEM INCORPORATING SAME

CROSS-REFERENCE TO RELATED APPLICATION

This patent application is based on and claims priority pursuant to 35 U.S.C. § 119(a) to Japanese Patent Application No. 2022-068874, filed on Apr. 19, 2022, in the Japan Patent Office, the entire disclosure of each of which is hereby incorporated by reference herein.

BACKGROUND

Technical Field

Embodiments of the present disclosure relate to a medium processing apparatus and an image forming system incorporating the medium processing apparatus.

Related Art

Medium processing apparatuses are known in the related art that bind, into a bundle, sheet-like media on which images are formed by image forming apparatuses. Since sheets of paper are widely known as an example of sheet-shaped media, a "sheet bundle" that is a stack of sheets of paper is used as an example of a bundle of sheet-shaped media in the following description. Such a medium processing apparatus includes, for example, a staple binder or a crimp binder (hereinafter, collectively referred to as a "binder"). The staple binder binds a sheet bundle using a staple. The crimp binder binds a sheet bundle by pressing and deforming the sheet bundle.

Some medium processing apparatuses configured as described above have a mechanism that changes the orientation of a binder between an oblique binding orientation in which media are bound obliquely with respect to the width direction (main scanning direction) of the media and a parallel binding orientation in which the media are bound in parallel with the width direction of the media.

SUMMARY

According to an embodiment of the present disclosure, a medium processing apparatus includes a conveyor, a tray, a binder, a mover, and a switcher. The conveyor conveys a medium in a conveyance direction. The tray supports a plurality of media conveyed by the conveyor. The binder binds the plurality of media supported on the tray. The mover moves the binder in a main scanning direction orthogonal to the conveyance direction along a surface of the plurality of media supported on the tray. The switcher guides a guided portion of the binder to switch between an oblique binding posture in which a longitudinal direction of a binding region bound by the binder is inclined with respect to the main scanning direction and a parallel binding posture in which the longitudinal direction of the binding region is oriented in the main scanning direction. The switcher includes a first passage, a second passage, a movable wall, and an urging member. The first passage extends in the main scanning direction. The guided portion enters the first passage when the binder is in the oblique binding posture. The second passage extends in the main scanning direction on an upstream side from the first passage in the conveyance direction. The guided portion enters the second passage when the binder is in the parallel binding posture. The movable wall moves between a blocking posture in which each of the first passage and the second passage is blocked by the movable wall and the first passage and the second passage communicate with each other and an open posture in which at least one of the first passage or the second passage is open. The urging member urges the movable wall toward the blocking posture. The movable wall guides the guided portion to the second passage while maintaining the blocking posture, when the guided portion moving along the first passage from an end side to a center side in the main scanning direction comes into contact with the movable wall; moves to the open posture and cause the guided portion to pass when the guided portion moving along the second passage from the end side to the center side in the main scanning direction comes into contact with the movable wall; guides the guided portion to the first passage while maintaining the blocking posture, when the guided portion moving along the second passage from the center side to the end side in the main scanning direction comes into contact with the movable wall; and moves to the open posture and cause the guided portion to pass when the guided portion moving along the first passage from the center side to the end side in the main scanning direction comes into contact with the movable wall.

According to another embodiment of the present disclosure, an image forming system includes an image forming apparatus and the medium processing apparatus. The image forming apparatus forms images on a plurality of media. The medium processing apparatus crimps and binds the plurality of media on which the images are formed by the image forming apparatus.

BRIEF DESCRIPTION OF THE DRAWINGS

A more complete appreciation of embodiments of the present disclosure and many of the attendant advantages and features thereof can be readily obtained and understood from the following detailed description with reference to the accompanying drawings, wherein.

Figure 1:
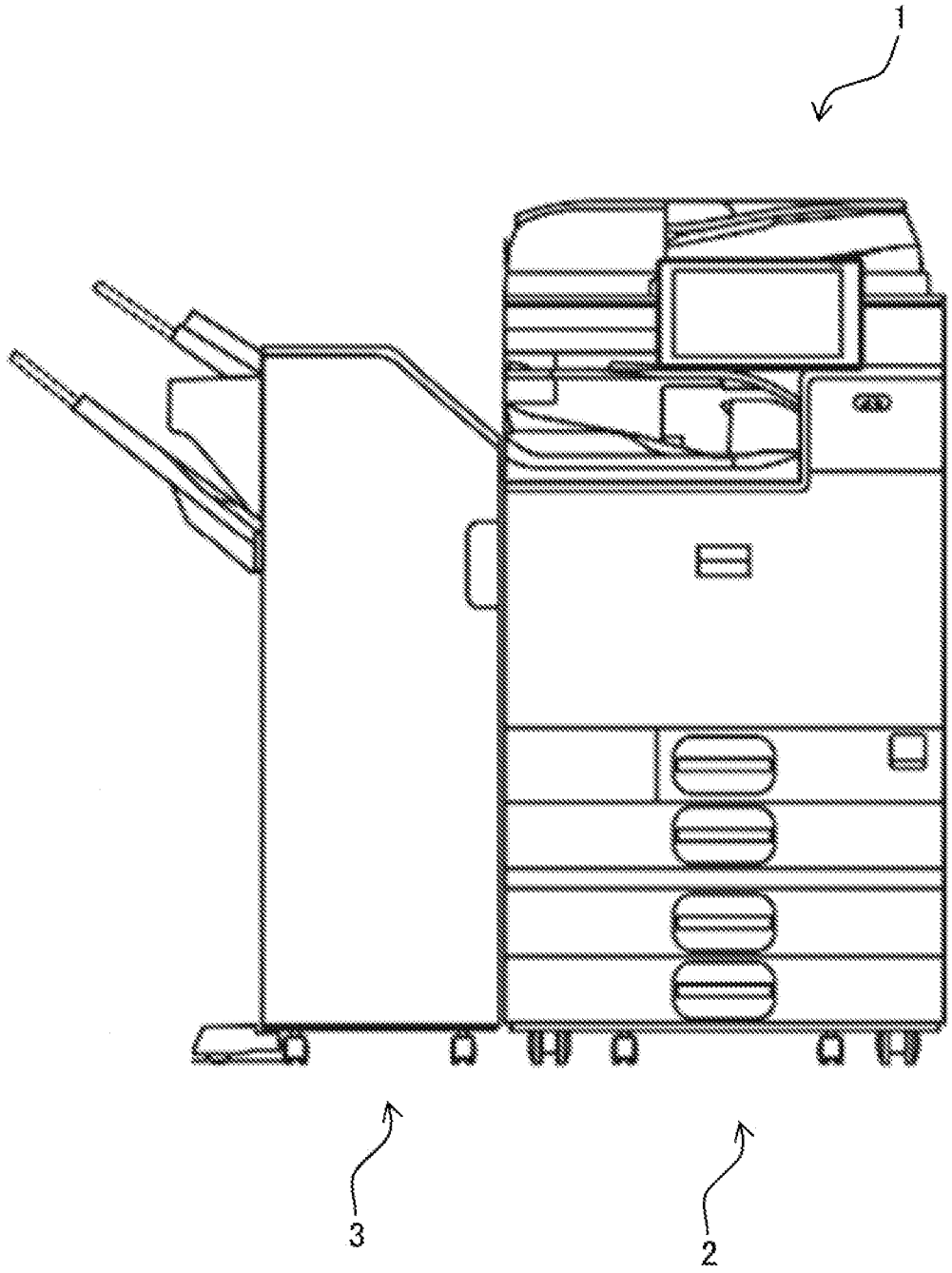
FIG. 1 is a diagram illustrating the overall configuration of an image forming system according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

Hereinafter, an embodiment of the present disclosure applied to a color laser printer (hereinafter, simply referred to as a printer) that is an image forming apparatus will be described.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

Initially, a description is given of a first embodiment of the present disclosure.

With reference to the drawings, a description is now given of an image forming system 1 according to an embodiment of the present disclosure. FIG. 1 is a diagram illustrating the overall configuration of the image forming system 1. The image forming system 1 has a function of forming an image on a sheet P as a medium and performing post-processing on the sheet P on which the image is formed. As illustrated in FIG. 1, the image forming system 1 includes an image forming apparatus 2 and a post-processing apparatus 3 (medium processing apparatus).

The image forming apparatus 2 forms an image on the sheet P and ejects the sheet having the image to the post-processing apparatus 3. The image forming apparatus 2 mainly includes a tray that holds a sheet (sheets) P, a conveyor that conveys the sheet P held in the tray, and an image formed that forms an image on the sheet P conveyed by the conveyor. The image former may be an inkjet image forming device that forms an image with ink or an electrophotographic image forming device that forms an image with toner. Since the image forming apparatus 2 has a typical configuration, a detailed description of the configuration and functions of the image forming apparatus 2 are omitted.

Figure 2:
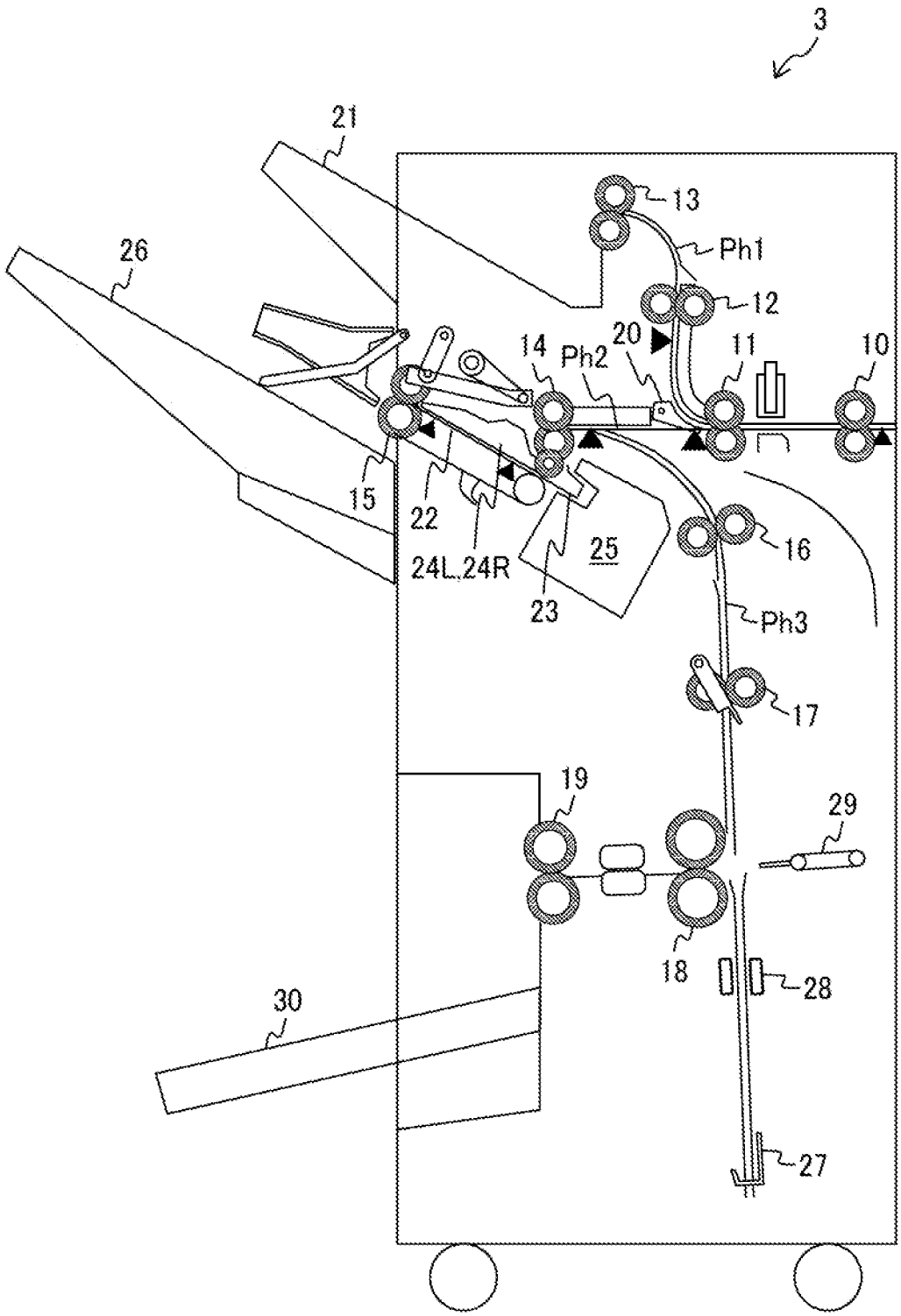
FIG. 2 is a diagram illustrating the internal configuration of a post-processing apparatus in the image forming system of FIG. 1.

FIG. 2 is a diagram illustrating an internal configuration of the post-processing apparatus 3. The post-processing apparatus 3 performs post-processing on the sheet P on which an image is formed by the image forming apparatus 2. The post-processing according to the first embodiment is staple processing for binding a bundle of a plurality of sheets P on which images are formed (hereinafter referred to as a "sheet bundle"). More specifically, the stapling processing according to the first embodiment is so-called "staple binding" in which a staple is passed through a sheet bundle to bind the sheets. Examples of the staple binding include an end binding processing of binding an end of a sheet bundle in the conveyance direction and a saddle binding processing of binding the center of the sheet bundle.

The post-processing apparatus 3 includes the conveyance roller pairs 10 to 19 serving as a conveyor and the switching claw 20. The conveyance roller pairs 10 to 19 convey, inside the post-processing apparatus 3, the sheet P supplied from the image forming apparatus 2. Specifically, the conveyance roller pairs 10 to 13 convey the sheet P along a first conveyance passage Ph1. The conveyance roller pairs 14 and 15 convey the sheet P along a second conveyance passage Ph2. The conveyance roller pairs 16 to 19 convey the sheet P along a third conveyance passage Ph3.

The first conveyance passage Ph1 is a passage extending to an output tray 21 from a supply port through which the sheet P is supplied from the image forming apparatus 2. The second conveyance passage Ph2 is a passage branching from the first conveyance passage Ph1 between the conveyance roller pairs 11 and 14 in a conveyance direction and extending to an output tray 26 via an internal tray 22. The third conveyance passage Ph3 is a passage branching from the first conveyance passage Ph1 between the conveyance roller pairs 11 and 14 in the conveyance direction and extending to an output tray 30.

The switching claw 20 is disposed at a branching position of the first conveyance passage Ph1 and the second conveyance passage Ph2. The switching claw 20 can be switched between a first position and a second position. The switching claw 20 in the first position guides the sheet P to be output to the output tray 21 through the first conveyance passage Ph1. The switching claw 20 in the second position guides the sheet P conveyed through the first conveyance passage Ph1 to the second conveyance passage Ph2. When a trailing end of the sheet P entering the second conveyance passage Ph2 passes through the conveyance roller pair 11, the conveyance roller pair 14 is rotated in the reverse direction to guide the sheet P to the third conveyance passage Ph3. The post-processing apparatus 3 further includes a plurality of sensors that detects the positions of the sheet P in the first conveyance passage Ph1, the second conveyance passage Ph2, and the third conveyance passage Ph3. In FIG. 2, each black triangle indicates a sensor that detects the position of the sheet P during conveyance.

The post-processing apparatus 3 includes the output tray 21. The output tray 21 supports the sheet P discharged through the first conveyance path Ph1. Among the sheets P supplied from the image forming apparatus 2, sheets P on which the stapling process is not executed are ejected to the output tray 21.

The post-processing apparatus 3 includes an internal tray 22 (tray), an end fence 23, side fences 24L and 24R, an end binding mechanism 25, and an output tray 26. The internal tray 22, the end fence 23, the side fences 24L and 24R, and the end binding mechanism 25 perform end binding processing on the sheets P conveyed on the second conveyance path Ph2. Among the sheets P supplied from the image forming apparatus 2, a sheet bundle on which the end stitching processing is executed is ejected to the output tray 26. Hereinafter, a direction from the conveyance roller pair 15 toward the end fence 23 is defined as a "sheet conveyance direction" of the sheet P. In addition, a direction orthogonal to both the thickness direction of the sheet P supported by the internal tray 22 and the conveyance direction of the sheet P is defined as a "main scanning direction (width direction of the sheet P)". The conveyance direction, the thickness direction, and the main scanning direction are orthogonal to each other.

The internal tray 22 temporarily supports a plurality of sheets P sequentially conveyed on the second conveyance path Ph2. The end fence 23 aligns the position of the sheet bundle held in the internal tray 22 in the conveyance direction of the sheet bundle. The side fences 24L and 24R align the position of the sheet bundle held in the internal tray 22 in the main scanning direction. The end binding mechanism 25 binds an end portion of the sheet bundle aligned by the end fence 23 and the side fences 24L and 24R. The conveyance roller pair 15 ejects the sheet bundle subjected to the end stitching processing to the output tray 26. The configuration of the end binding mechanism 25 will be described below with reference to FIGS. 3 to 10.

The post-processing apparatus 3 further includes an end fence 27, a binder 28, a sheet folding blade 29, and an output tray 30. The end fence 27, the binder 28, and the sheet folding blade 29 perform saddle stitching processing on the sheet P conveyed on the third conveyance path Ph3. Among the sheets P supplied from the image forming apparatus 2, a sheet bundle subjected to the saddle stitching process is ejected to the output tray 30.

The end fence 27 aligns the positions of the sheets P that are sequentially conveyed through the third conveyance passage Ph3, in a direction in which the sheets P are conveyed. Further, the end fence 27 is movable between a binding position where the center of the sheet bundle faces the binder 28 and a folding position where the center of the sheet bundle faces the sheet folding blade 29. The binder 28 binds the center of the sheet bundle aligned by the end fence 27 at the binding position. The sheet folding blade 29 folds the sheet bundle in half while the sheet bundle is supported by the end fence 27 at the folding position, and then brings the sheet bundle to the conveyance roller pair 18 so that the conveyance roller pair 18 nips the sheet bundle. Then, the conveyance roller pairs 18 and 19 eject the sheet bundle subjected to the saddle stitching process to the output tray 30.

Figure 3:
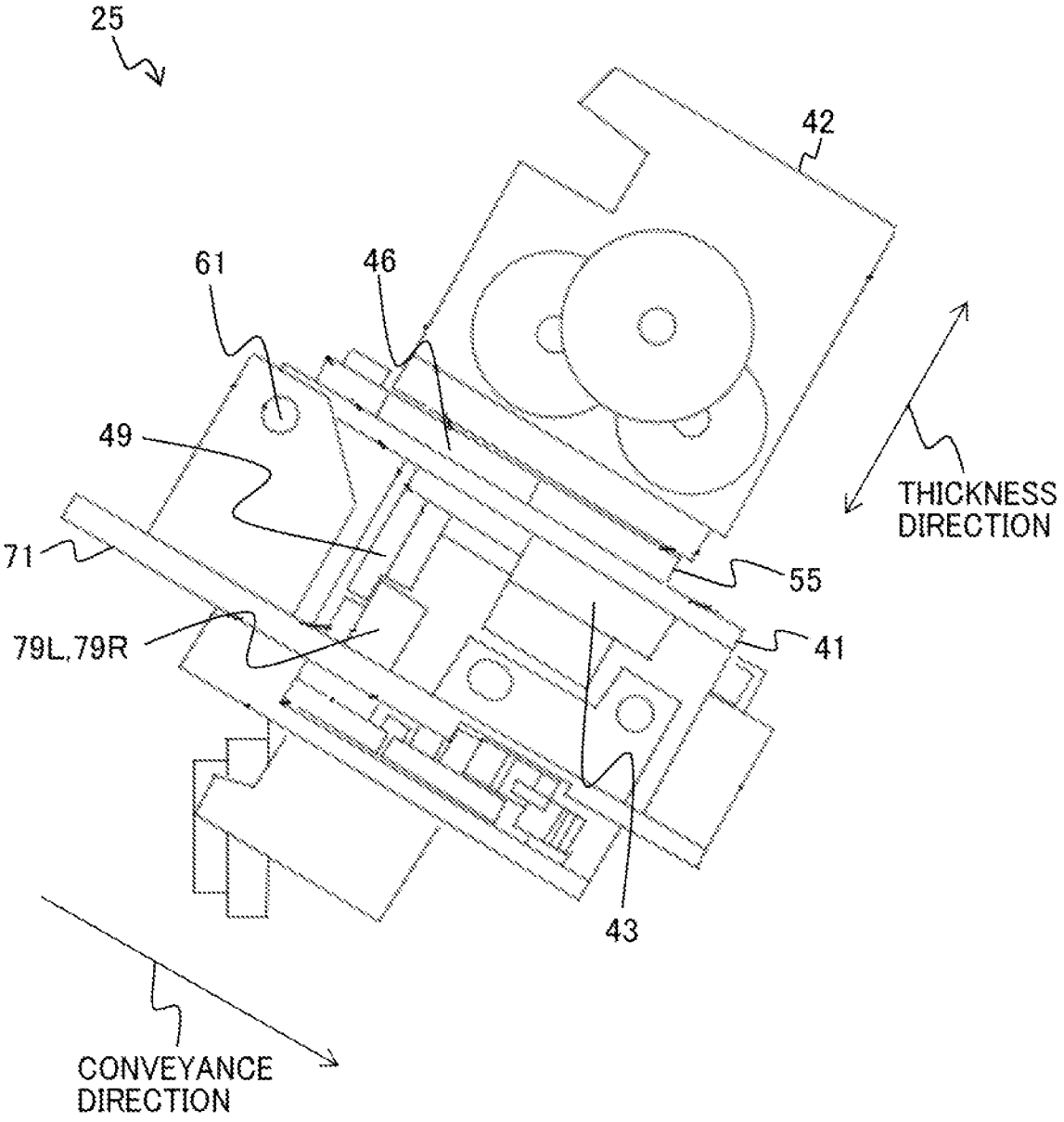
FIG. 3 is a side view of an end binding mechanism according to a first embodiment.
Figure 4:
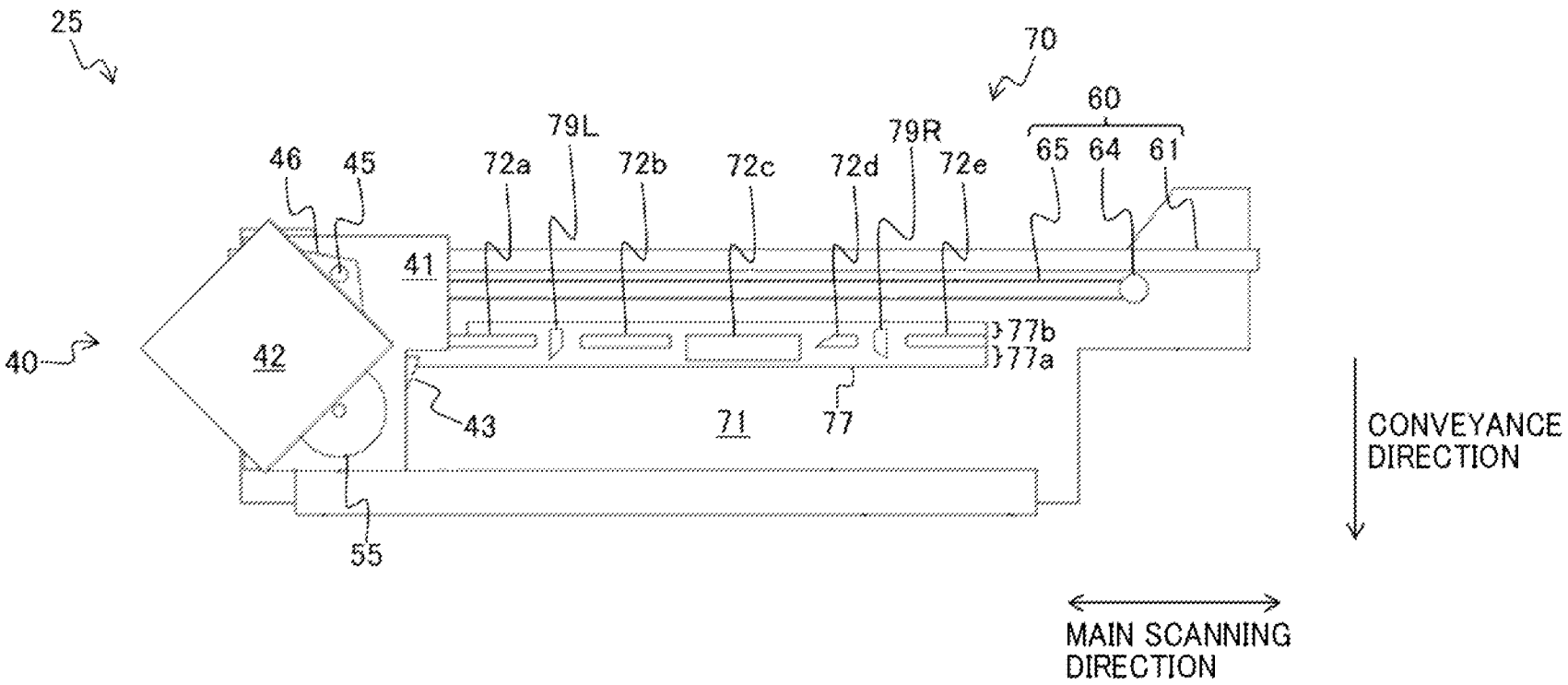
FIG. 4 is a plan view of the end binding mechanism according to the first embodiment.

FIG. 3 is a side view of the end binding mechanism 25 according to the first embodiment. FIG. 4 is a plan view of the end binding mechanism 25 according to the first embodiment. As illustrated in FIGS. 3 and 4, the end binding mechanism 25 mainly includes a staple binder 40 which is an example of a binder, a mover 60, and a switcher 70. The staple binder 40 performs staple binding on the plurality of sheets P supported on the internal tray 22. The mover 60 moves the staple binder 40 in the main scanning direction along the surface of the sheet P supported by the internal tray 22. The switcher 70 switches the staple binder 40 (more specifically, a binding section 42 described later) between the oblique binding posture and the parallel binding posture.

Figure 5B:
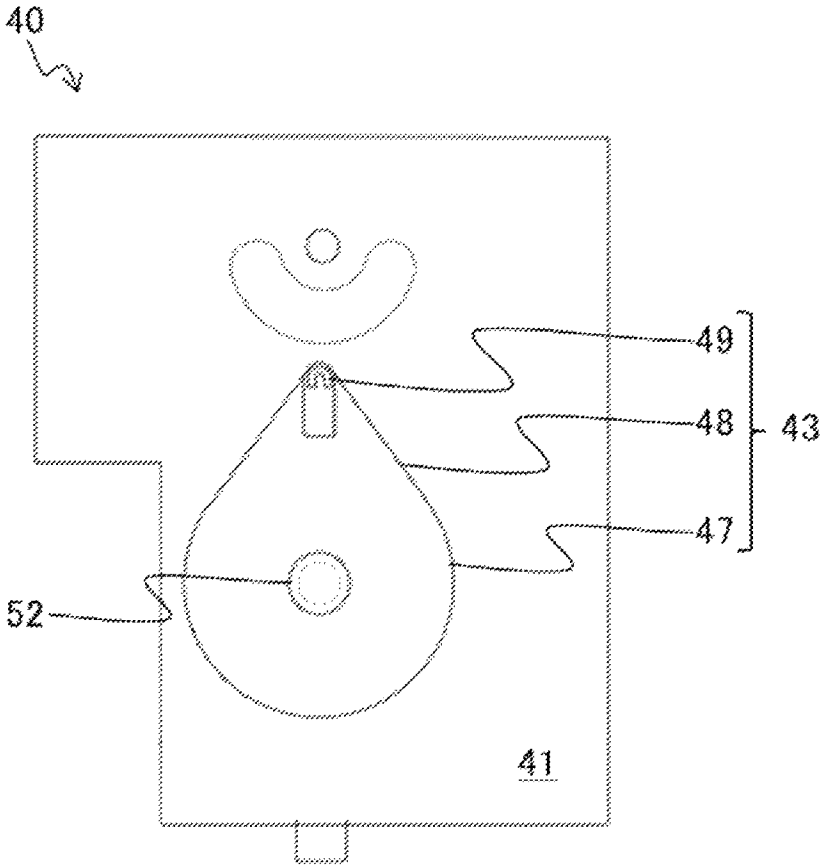
FIG. 5B is a diagram of the staple binder viewed from a lower surface side of the staple binder.
Figure 5A:
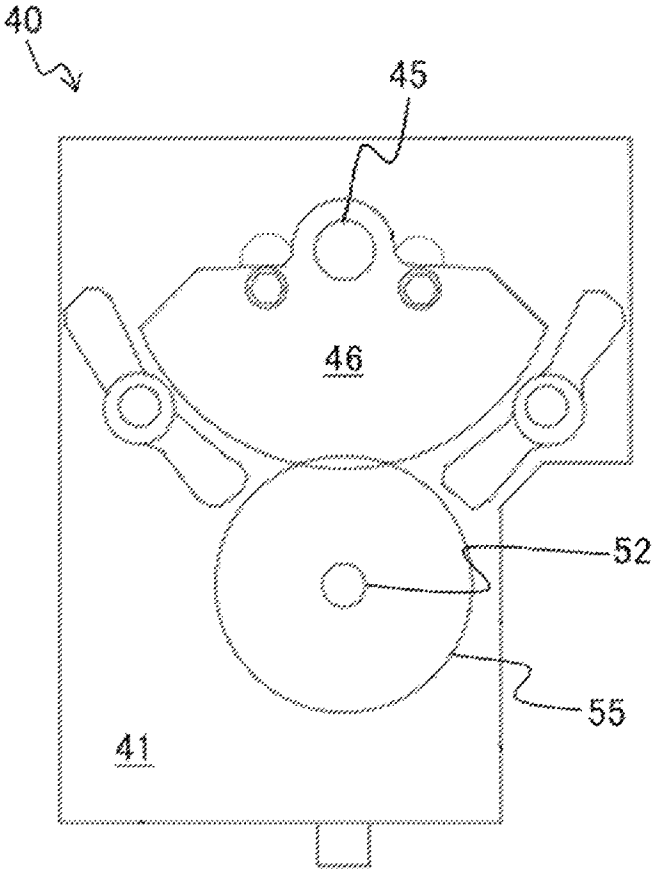
FIG. 5A is a diagram of a staple binder viewed from an upper surface side of the staple binder.
Figure 6B:
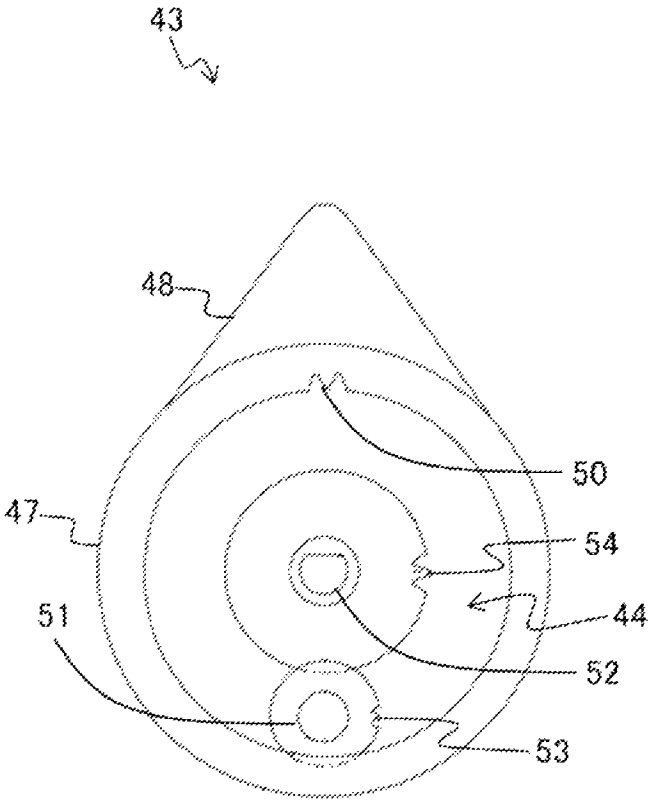
FIG. 6B is a plan view of the cam.
Figure 6A:
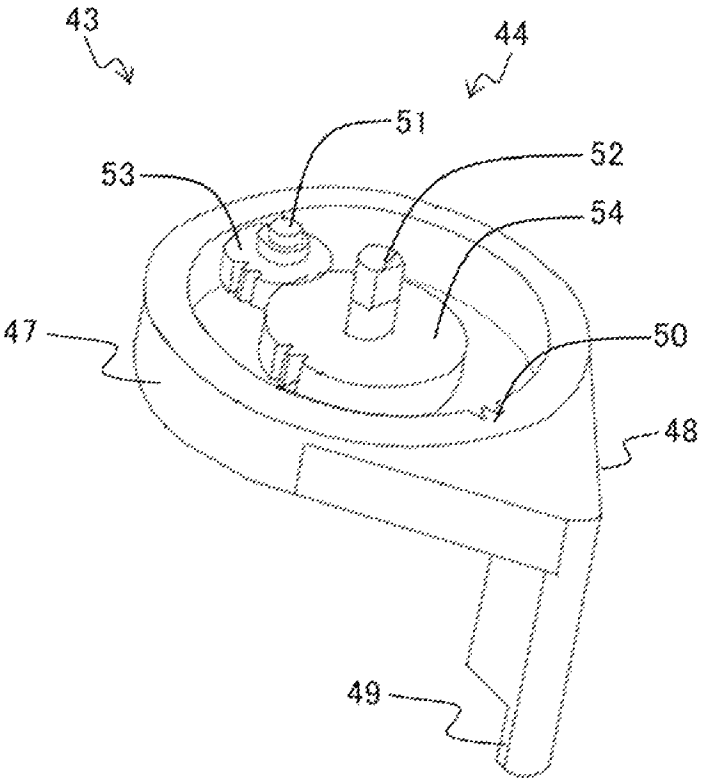
FIG. 6A is a perspective view of a cam.

FIG. 5A is a diagram of the staple binder 40 viewed from an upper surface side of the staple binder 40. FIG. 5B is a diagram of the staple binder 40 viewed from a lower surface side of the staple binder 40. FIG. 6A is a perspective view of the cam 43. FIG. 6B is a plan view of the cam 43. As illustrated in FIGS. 3 to 6B, the staple binder 40 mainly includes a base 41, the binding section 42, the cam 43, and a transmission mechanism 44.

The base 41 is a plate member that supports the binding section 42, the cam 43, and the transmission mechanism 44. The binding section 42 as a rotary binder is supported on the upper surface side of the base 41 such that the binding section 42 is rotatable about a rotation shaft 45 (first rotation axis) extending in the thickness direction of the sheets P. An external gear 46 is attached to the binding section 42 and rotates together with the binding section 42. The binding section 42 includes, for example, a magazine that stores a plurality of staples and a clamping mechanism that presses staples stored in the magazine against the sheet bundle and clamps the sheet bundle from both sides. The configuration of the binding section 42 may be an already-known configuration.

The cam 43 is supported on the lower surface side of the base 41 such that the cam 43 is rotatable about a rotation shaft 52 (second rotation axis) extending in the thickness direction of the sheet P. As illustrated in FIG. 6A, the cam 43 mainly includes a cylindrical portion 47, a protruding portion 48, and a guided portion 49. The cylindrical portion 47 is a bottomed cylindrical body in which one side in the axial direction is closed and the other side in the axial direction is open. An internal gear 50 is formed on the inner peripheral surface of the cylindrical portion 47. The protruding portion 48 protrudes radially outward from a part of the outer circumferential surface of the cylindrical portion 47. The guided portion 49 protrudes from the distal end of the protruding portion 48 in a direction opposite to the base 41. The guided portion 49 is guided by the switcher 70 to rotate the cam 43.

The transmission mechanism 44 transmits the rotation of the cam 43 to the binding section 42. The transmission mechanism 44 mainly includes rotation shafts 51 and 52, a first gear 53, a second gear 54, and a third gear 55. The components 51, 52, 53, 54, and 55 of the transmission mechanism 44 are disposed inside the cylindrical portion 47 (that is, the internal gear 50).

The rotation shafts 51 and 52 extend in the thickness direction of the sheet P. The rotation shaft 51 is rotatably supported by the cam 43 (more specifically, the cylindrical portion 47) on the lower surface side of the base 41. The rotation shaft 52 is rotatably supported by the base 41 and penetrates the base 41 in the thickness direction. The rotation shaft 52 rotatably supports the cam 43. However, the cam 43 and the rotation shaft 52 rotate independently of each other. In other words, the cam 43 and the rotation shaft 52 do not rotate together.

The first gear 53 is supported by the rotation shaft 51 on the lower surface side of the base 41 and rotates together with the rotation shaft 51. The first gear 53 is meshed with the internal gear 50 and the second gear 54. The second gear 54 is supported by the rotation shaft 52 on the lower surface side of the base 41 and rotates together with the rotation shaft 52. The second gear 54 is meshed with the first gear 53. The third gear 55 is supported by the rotation shaft 52 on the upper surface side of the base 41 and rotates together with the rotation shaft 52. In other words, the rotation shaft 52, the second gear 54, and the third gear 55 rotate together. The third gear 55 is meshed with the external gear 46.

In other words, the rotation of the cam 43 is transmitted to the binding section 42 via the internal gear 50, the first gear 53, the second gear 54, the rotation shaft 52, the third gear 55, and the external gear 46. Accordingly, when the staple binder 40 is viewed in a plan view, the binding section 42 rotates in a direction opposite to the rotation direction of the cam 43. As a result, the binding section 42 is switched between the oblique binding posture and the parallel binding posture.

Figure 16A:
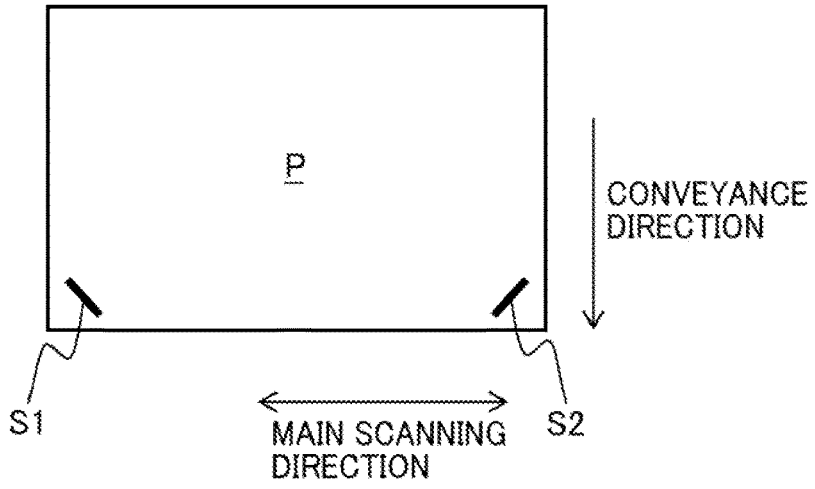
FIGS. 16A, 16B, and 16C are diagrams illustrating positions and orientations of binding staples for binding a sheet bundle.
Figure 16B:
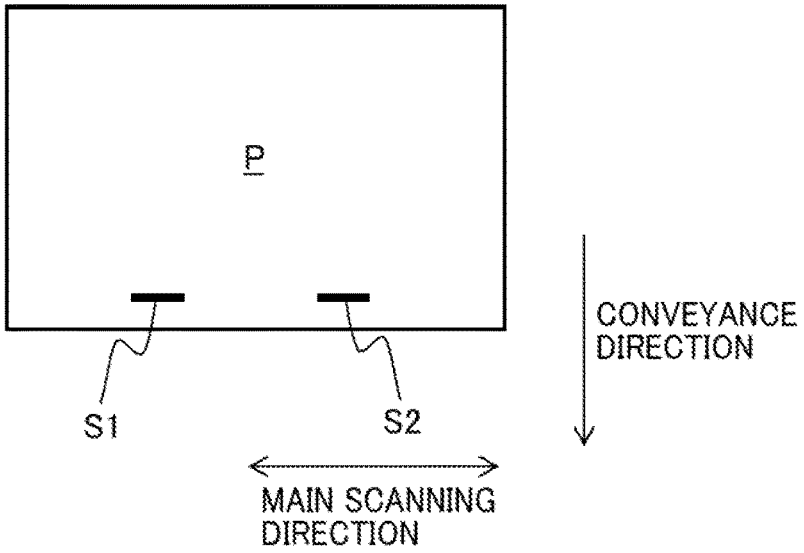
Figure 16C:
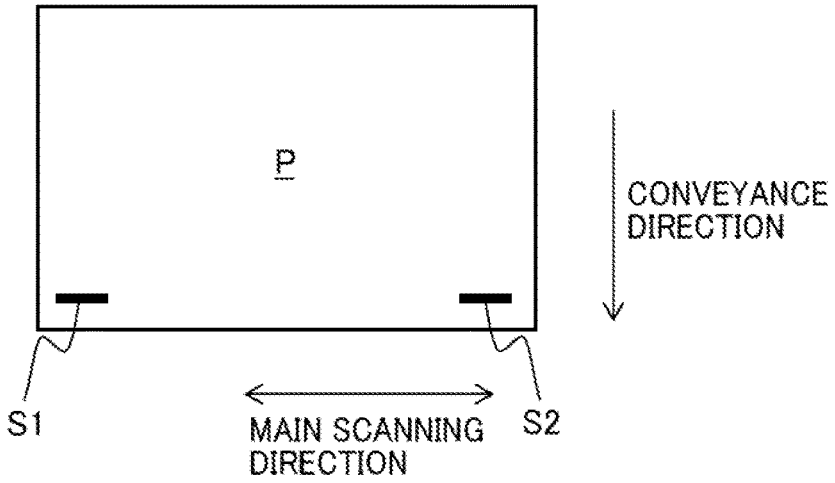

As illustrated in FIG. 16A, the oblique binding posture is a posture of the staple binder 40 (the binding section 42) that binds a sheet bundle in a state in which the longitudinal direction of each of binding staples S1 and S2 is inclined with respect to the main scanning direction. As illustrated in FIGS. 16B and 16C, the parallel binding posture is a posture of the staple binder 40 (the binding section 42) that binds a sheet bundle in a state in which the longitudinal direction of each of the binding staples S1 and S2 is oriented in the main scanning direction. The region where the binding staples S1 and S2 are arranged on the sheet bundle is an example of a binding region.

Figure 11:
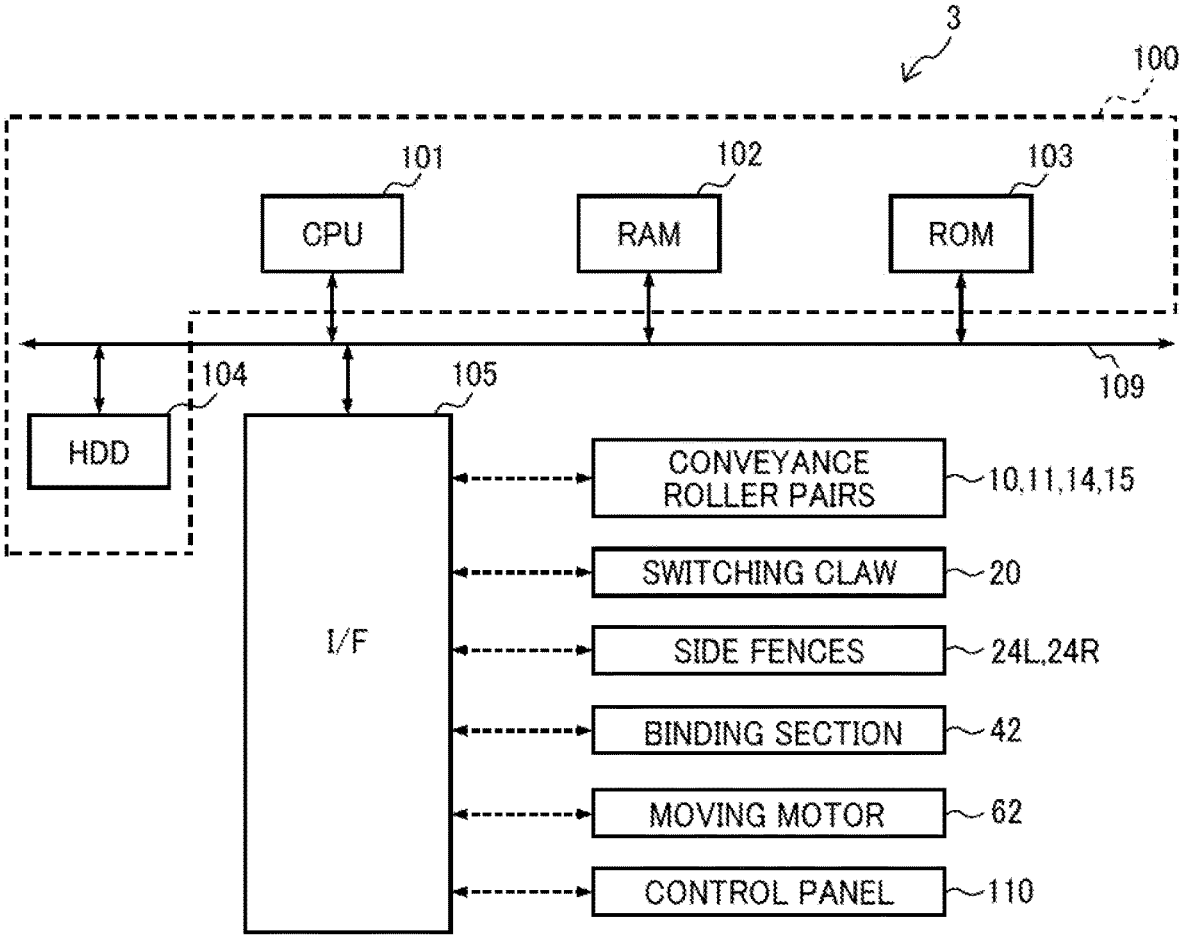
FIG. 11 is a block diagram illustrating a hardware configuration of the post-processing apparatus of FIG. 2 to control the operation of the post-processing apparatus.

The mover 60 mainly includes a guide shaft 61 and a moving motor 62 (see FIG. 11). The guide shaft 61 extends in the main scanning direction on the downstream side of the internal tray 22 in the conveyance direction. The guide shaft 61 supports the staple binder 40 such that the staple binder 40 is movable in the main scanning direction. The moving motor 62 generates a driving force for moving the staple binder 40 in the main scanning direction. When the driving force of the moving motor 62 is transmitted via the pulleys 63 and 64, the timing belt 65, and the like, the staple binder 40 moves in the main scanning direction along the guide shaft 61.

Figure 7A:
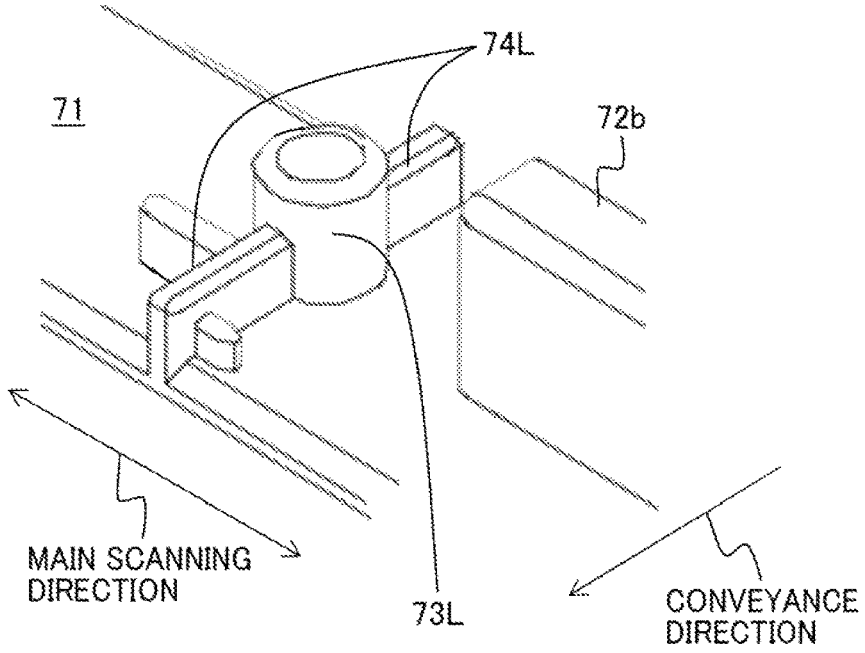
FIG. 7A is a perspective view of a boss and a restriction wall.
Figure 7B:
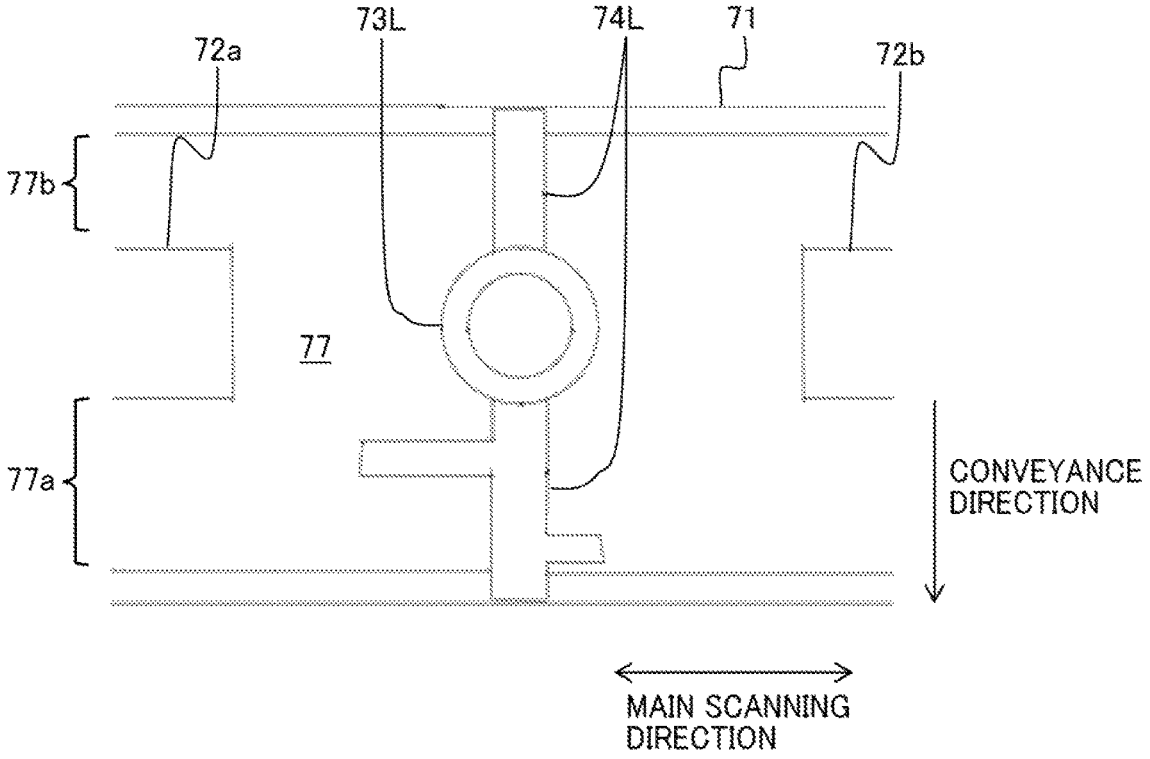
FIG. 7B is a plan view of the boss and the restriction wall.
Figure 8A:
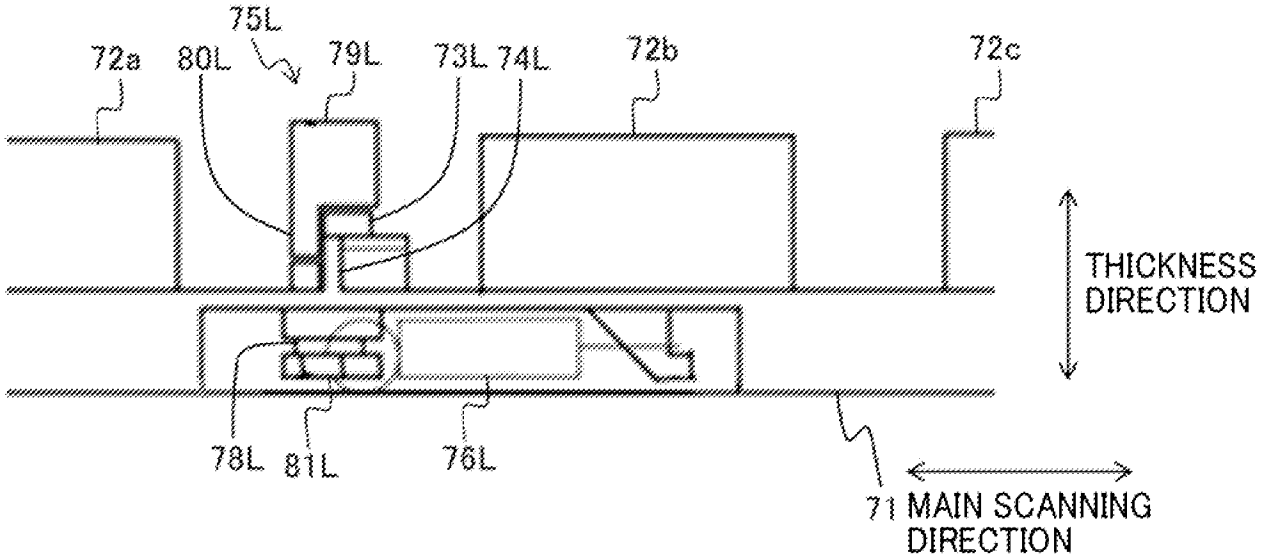
FIG. 8A is a cross-sectional view of a base plate.
Figure 8B:
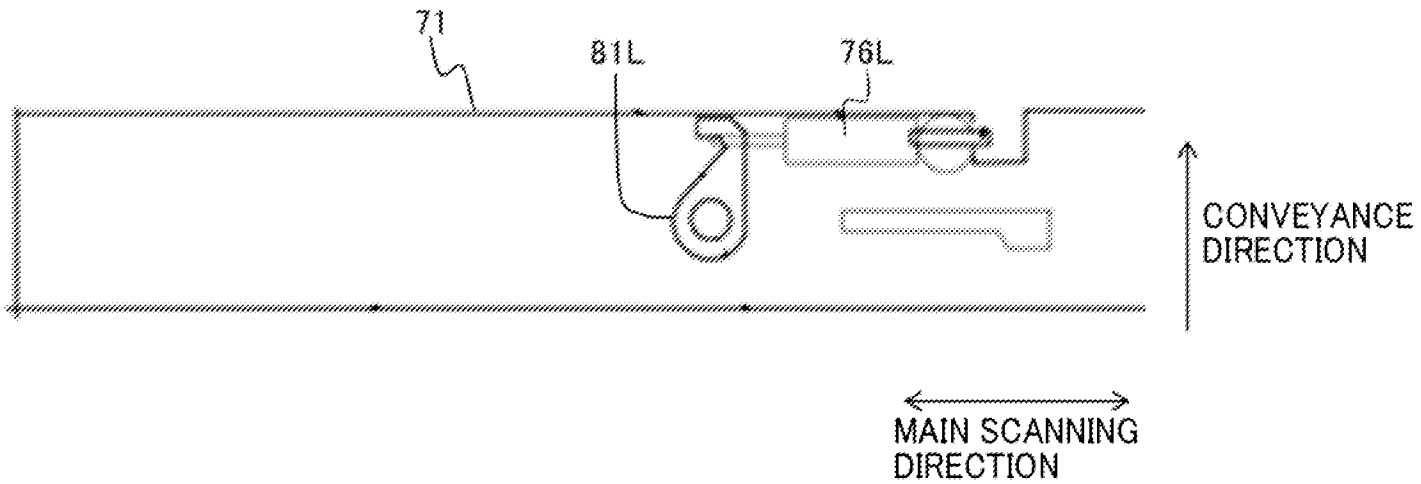
FIG. 8B is a bottom view of the base plate.
Figure 9:
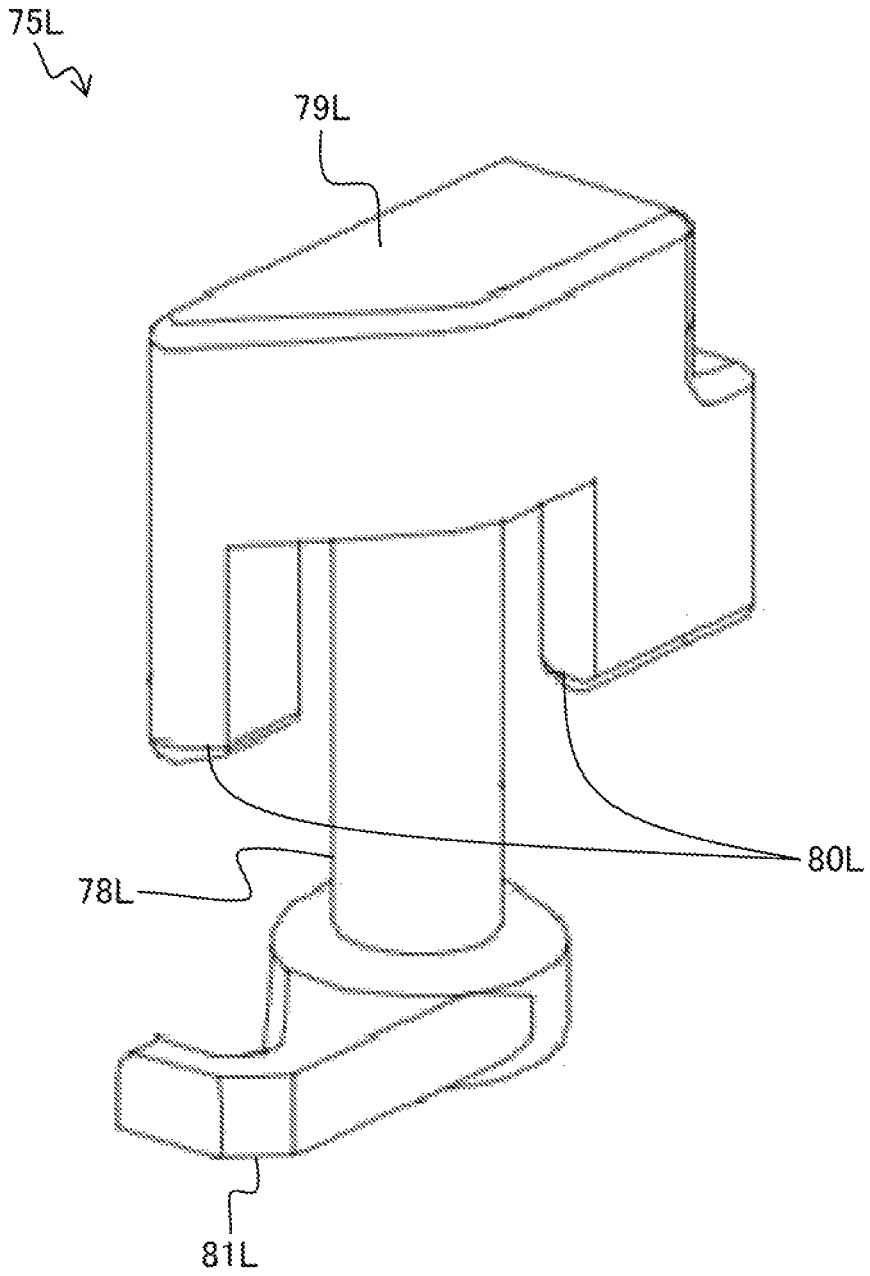
FIG. 9 is a perspective view of a movable member.
Figure 10A:
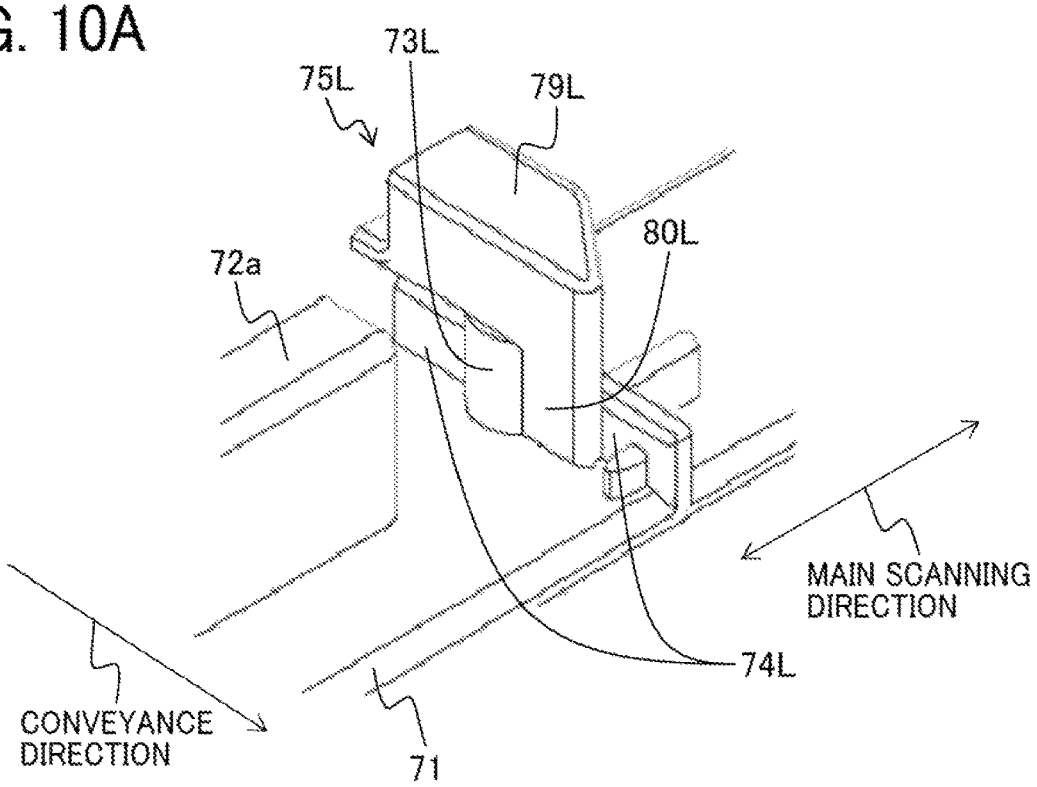
FIG. 10A is a perspective view illustrating the movable member attached to the boss.
Figure 10B:
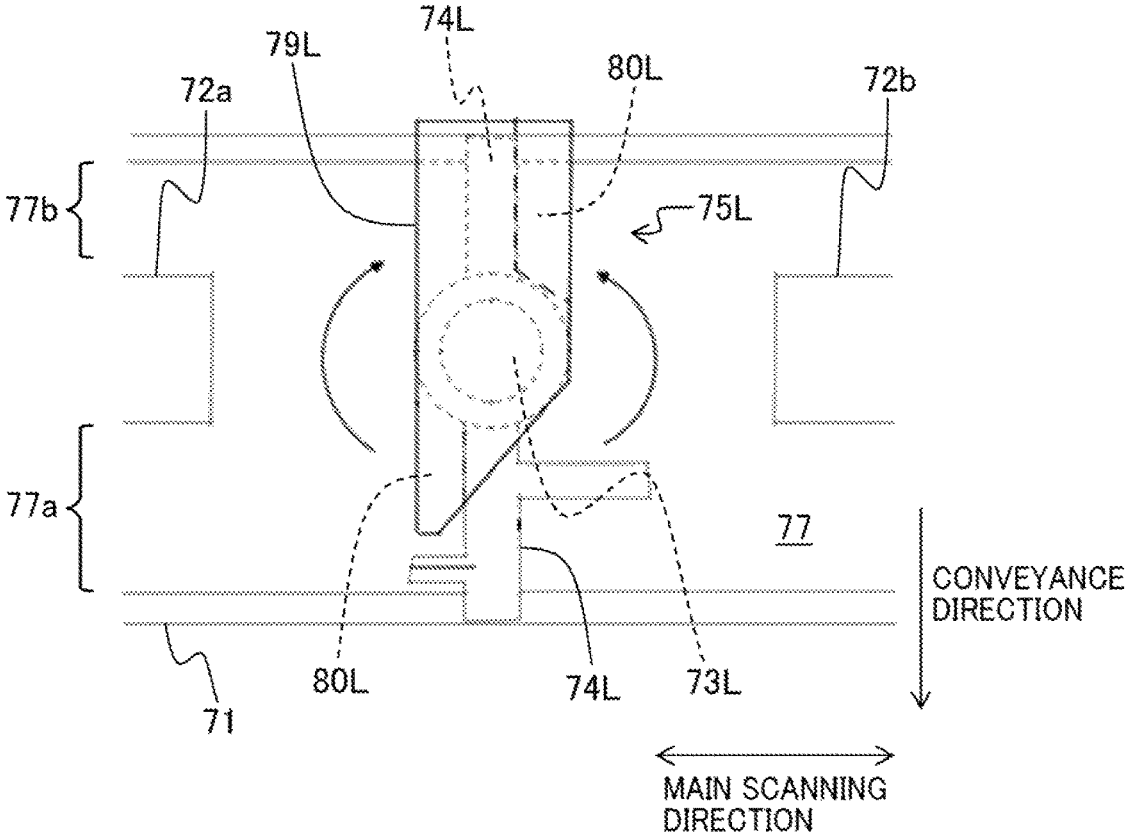
FIG. 10B is a plan view illustrating the movable member attached to the boss.

FIG. 7A is a perspective view of a boss 73L (or a boss 73R) and a restriction wall 74L (or the restriction wall 74R). FIG. 7B is a plan view of the boss 73L (or the boss 73R) and the restriction wall 74L (or the restriction wall 74R). FIG. 8A is a cross-sectional view of a base plate 71. FIG. 8B is a bottom view of the base plate 71. FIG. 9 is a perspective view of a movable member 75L (or a movable member 75R). FIG. 10A is a perspective view of the movable member 75L (or the movable member 75R) attached to the boss 73L (or the boss 73R). FIG. 10B is a plan view of the movable member 75L (or the movable member 75R) attached to the boss 73L (or the boss 73R).

The switcher 70 guides the guided portion 49 and rotates the cam 43 to switch the staple binder 40 (more specifically, the staple binding section 42) between the oblique binding posture and the parallel binding posture. The switcher 70 mainly includes a base plate 71, guide walls 72*a*, 72*b*, 72*c*, 72*d*, and 72*e*, the bosses 73L and 73R, the restriction walls 74L and 74R, the movable members 75L and 75R, and coil springs 76L and 76R (urging members).

As illustrated in FIG. 4, the base plate 71 is a plate member extending over the entire range of movement of the staple binder 40 below the staple binder 40. The base plate 71 has a recess 77. The guide walls 72*a*, 72*b*, 72*c*, 72*d*, and 72*e* are disposed inside the recess 77 at predetermined intervals in the main scanning direction. The guide walls 72*a*, 72*b*, 72*c*, 72*d*, and 72*e* partition the recess 77 into a first passage 77*a* and a second passage 77*b*. The first passage 77*a* and the second passage 77*b* communicate with each other through the gaps between adjacent ones of the guide walls 72*a*, 72*b*, 72*c*, 72*d*, and 72*e*.

The first passage 77*a* extends in the main scanning direction on the downstream side of the second passage 77*b* in the conveyance direction. The guided portion 49 enters the first passage 77*a* when the binding section 42 is in the oblique binding posture. The second passage 77*b* extends in the main scanning direction on the upstream side of the first passage 77*a* in the conveyance direction. The guided portion 49 enters the second passage 77*b* when the binding section 42 is in the parallel binding posture. In other words, when the staple binder 40 moves in the main scanning direction, the guided portion 49 moves along the first passage 77*a* or the second passage 77*b*.

The bosses 73L and 73R are spaced apart from each other in the main scanning direction in the recess 77. More specifically, the boss 73L is disposed between the guide walls 72*a* and 72*b*, and the boss 73R is disposed between the guide walls 72*d* and 72*e*. The bosses 73L and 73R are disposed at a boundary between the first passage 77*a* and the second passage 77*b* in the conveyance direction. As illustrated in FIG. 7A, each of the bosses 73L and 73R has a cylindrical outer shape protruding from the recess 77 in the thickness direction of the sheet P. As illustrated in FIG. 8, the internal space of each of the bosses 73L and 73R penetrates to the back surface side of the base plate 71. The bosses 73L and 73R rotatably support shaft portions 78L and 78R of movable members 75L and 75R, respectively, which will be described below.

As illustrated in FIG. 7, the restriction walls 74L and 74R extend from the bosses 73L and 73R to both sides in the conveyance direction. The restriction walls 74L and 74R, respectively, are disposed at positions at which the restriction walls 74L and 74R can come into contact with contact walls 80L and 80R of the movable members 75L and 75R, which will be described below. The restriction walls 74L and 74R, respectively, restrict rotation of the movable members 75L and 75R in the first direction, and allow rotation of the movable members 75L and 75R in the second direction. On the other hand, the restriction walls 74L and 74R are disposed at positions where the restriction walls 74L and 74R do not contact the guided portion 49.

The movable members 75L and 75R, respectively, are supported by the bosses 73L and 73R such that the movable members 75L and 75R are rotatable (an example of movable) about rotation axes extending in the thickness direction of the sheet P. Since the movable members 75L and 75R have the same shape except that the left and right (in the main scanning direction) are reversed, the movable member 75L will be described in detail below. As illustrated in FIG. 9, the movable member 75L mainly includes the shaft portion 78L, a movable wall 79L, the contact wall 80L, and an engagement portion 81L.

As illustrated in FIG. 8A, the shaft portion 78L is inserted into the boss 73L and is rotatably supported. One end of the shaft portion 78L protrudes toward the upper surface side of the base plate 71, and the other end of the shaft portion 78L protrudes toward the lower surface side of the base plate 71. The movable wall 79L is attached to one end of the shaft portion 78L. The movable wall 79L is disposed at a position where the movable wall 79L can come into contact with the guided portion 49 and does not come into contact with the restriction wall 74L. The longitudinal direction of the movable wall 79L is oriented in the conveyance direction in a blocking posture (FIG. 12A) described later, and is oriented in the main scanning direction in an open posture (FIG. 12C) described later.

The contact wall 80L protrudes toward the base plate 71 from both sides of the movable wall 79L in the main scanning direction. When the movable member 75L is about to rotate in the first direction (counterclockwise in FIG. 10B), the contact wall 80L comes into contact with the restriction wall 74L to prevent the rotation of the movable member 75L. On the other hand, when the movable member 75L is about to rotate in the second direction (clockwise in FIG. 10B), the contact wall 80L is separated from the restriction wall 74L to allow the rotation of the movable member 75L.

As illustrated in FIG. 8A, the engagement portion 81L is attached to the other end of the shaft portion 78L. One end of the coil spring 76L disposed on the lower surface side of the base plate 71 is locked to the engagement portion 81L. One end of the coil spring 76L is engaged with the engagement portion 81L, and the other end of the coil spring 76L is fixed to the base plate 71. The coil spring 76L spring urges the movable member 75L such that the movable wall 79L moves toward the blocking posture. In other words, the movable wall 79L receives the urging force of the coil spring 76L and the contact wall 80L comes into contact with the restriction wall 74L. Accordingly, the movable wall 79L is maintained in the blocking posture.

The blocking posture is a posture of the movable wall 79L taken when each of the first passage 77*a* and the second passage 77*b* is blocked and the first passage 77*a* and the second passage 77*b* are communicated with each other. The longitudinal direction of the movable wall 79L in the blocking posture is oriented in the conveyance direction. As a result, when the movable wall 79L is in the blocking posture, the guided portion 49 that moves in the first passage 77*a* or the second passage 77*b* does not go over the movable wall 79L. On the other hand, when the movable wall 79L is in the blocking posture, the guided portion 49 can move from one of the first passage 77*a* and the second passage 77*b* to the other of the first passage 77*a* and the second passage 77*b*.

The open posture is a posture of the movable wall 79L taken when at least one (in the first embodiment, both) of the first passage 77*a* and the second passage 77*b* is opened. The longitudinal direction of the movable wall 79L in the open posture is oriented in the main scanning direction. In other words, the movable wall 79L rotates by 90° around the rotation axis (shaft portion 78L) extending in the thickness direction of the sheet P between the blocking posture and the open posture. As a result, the guided portion 49 moving in the first passage 77*a* or the second passage 77*b* can go over the movable wall 79L.

When the guided portion 49 moving in the first passage 77*a* from an end side to the center side (the right direction in FIG. 10B) in the main scanning direction comes into contact with the movable wall 79L in the blocking posture, the contact wall 80L comes into contact with the restriction wall 74L and the movable wall 79L is maintained in the blocking posture. The guided portion 49 is guided from the first passage 77*a* to the second passage 77*b* along the side surface of the movable wall 79L maintained in the blocking posture. As a result, the binding section 42 changes its posture from the oblique binding posture to the parallel binding posture.

When the guided portion 49 moving in the second passage 77*b* from an end side to the center side (right direction in FIG. 10B) in the main scanning direction comes into contact with the movable wall 79L, the movable wall 79L rotates from the blocking posture to the open posture. The movable wall 79L in the open posture causes the guided portion 49 of the second passage 77*b* to pass to the center side in the main scanning direction. When the guided portion 49 passes, the movable wall 79L returns to the blocking posture by the urging force of the coil spring 76L.

When the guided portion 49 moving in the second passage 77*b* from the center side to an end side (the left direction in FIG. 10B) in the main scanning direction comes into contact with the movable wall 79L in the blocking posture, the contact wall 80L comes into contact with the restriction wall 74L, and the movable wall 79L is maintained in the blocking posture. The guided portion 49 is guided from the second passage 77*b* to the first passage 77*a* along the side surface of the movable wall 79L maintained in the blocking posture. As a result, the binding section 42 changes its posture from the parallel binding posture to the oblique binding posture.

When the guided portion 49 moving in the first passage 77*a* from the center side to an end side (the left direction in FIG. 10B) in the main scanning direction comes into contact with the movable wall 79L, the movable wall 79L rotates from the blocking posture to the open posture. The movable wall 79L in the open posture allows the guided portion 49 of the first passage 77*a* to pass to the end side in the main scanning direction. When the guided portion 49 passes, the movable wall 79L returns to the blocking posture by the urging force of the coil spring 76L.

FIG. 11 is a block diagram illustrating a hardware configuration of the post-processing apparatus 3 to control an operation of the post-processing apparatus 3. As illustrated in FIG. 11, the post-processing apparatus 3 includes a central processing unit (CPU) 101, a random access memory (RAM) 102, a read only memory (ROM) 103, a hard disk drive (HDD) 104, and an interface (I/F) 105. The CPU 101, the RAM 102, the ROM 103, the HDD 104, and the I/F 105 are connected to each other via a common bus 109.

The CPU 101 is an arithmetic unit and controls the overall operation of the post-processing apparatus 3. The RAM 102 is a volatile storage medium that allows data to be read and written at high speed. The CPU 101 uses the RAM 102 as a working area for data processing. The ROM 103 is a read-only non-volatile storage medium that stores programs such as firmware. The HDD 104 is a non-volatile storage medium that allows data to be read and written and has a relatively large storage capacity. The HDD 104 stores, e.g., an operating system (OS), various control programs, and application programs.

By an arithmetic function of the CPU 101, the post-processing apparatus 3 processes, for example, a control program stored in the ROM 103 and an information processing program (application program) loaded into the RAM 102 from a storage medium such as the HDD 104. Such processing configures a software controller including various functional modules of the post-processing apparatus 3. The software controller thus configured cooperates with hardware resources of the post-processing apparatus 3 to construct functional blocks that implement functions of the post-processing apparatus 3. In other words, the CPU 101, the RAM 102, the ROM 103, and the HDD 104 construct a controller 100 that controls the operation of the post-processing apparatus 3.

The I/F 105 is an interface that connects the conveyance roller pairs 10, 11, 14, and 15, the switching claw 20, the side fences 24L and 24R, the binding section 42, the moving motor 62, and a control panel 110 to the common bus 109.

The controller 100 operates the conveyance roller pairs 10, 11, 14, and 15, the switching claw 20, the side fences 24L and 24R, the binding section 42, and the moving motor 62 through the I/F 105. The controller 100 also grasps the position of the staple binder 40 in the main scanning direction by a position sensor (e.g., a rotary encoder of the moving motor 62 or a linear encoder disposed on a moving path of the staple binder 40). Although FIG. 11 illustrates the components that execute the edge stitching processing, the components that execute the saddle stitching process are also similarly controlled by the controller 100.

The control panel 110 includes an operation device that receives instructions from a user and a display serving as a notifier that notifies the user of information. The operation device includes, for example, hard keys and a touch screen overlaid on a display. The control panel 110 acquires information from the user through the operation device and provides information to the user through the display. Note that a specific example of the notifier is not limited to the display and may be a light emitting diode (LED) lamp or a speaker.

Figure 14A:
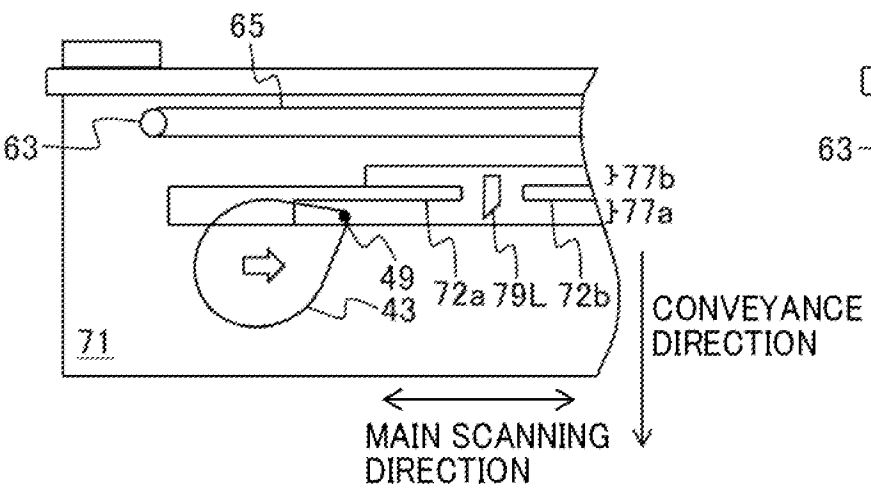
FIGS. 14A, 14B, and 14C are diagrams illustrating the movement of the cam when the binding section in the oblique binding posture on the end side is brought into the parallel binding posture on the end side.
Figure 14B:
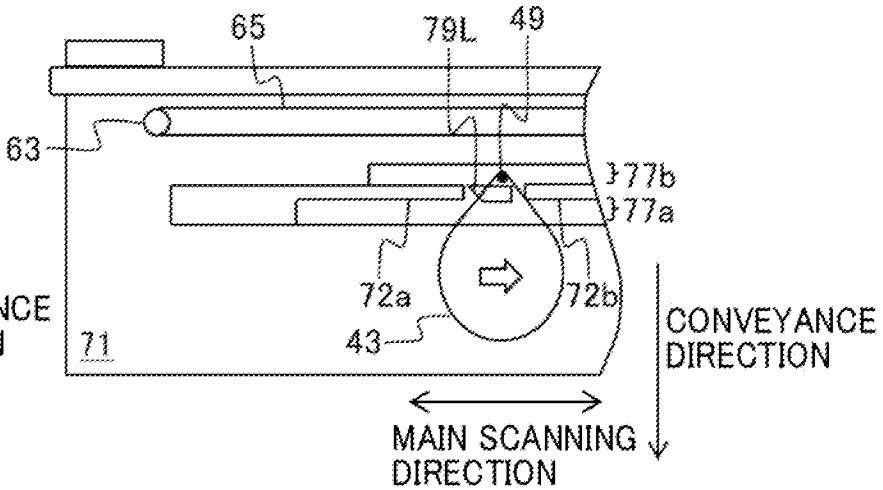
Figure 14C:
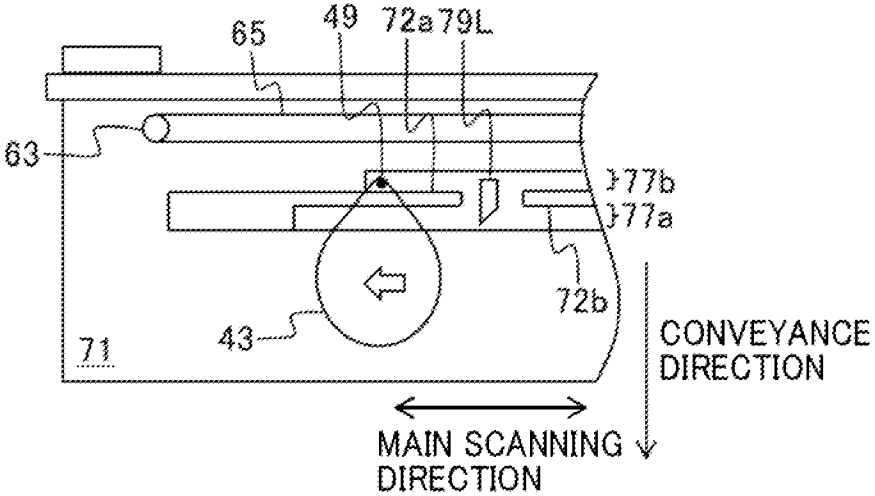
Figure 15A:
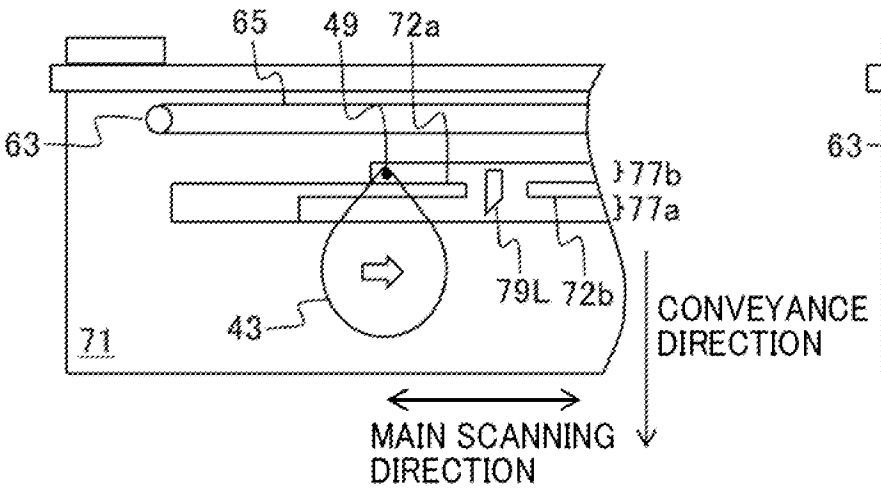
FIGS. 15A, 15B, and 15C are diagrams illustrating the movement of the cam when the binding section in the parallel binding posture at the end side is brought into the parallel binding posture at the center side.
Figure 15B:
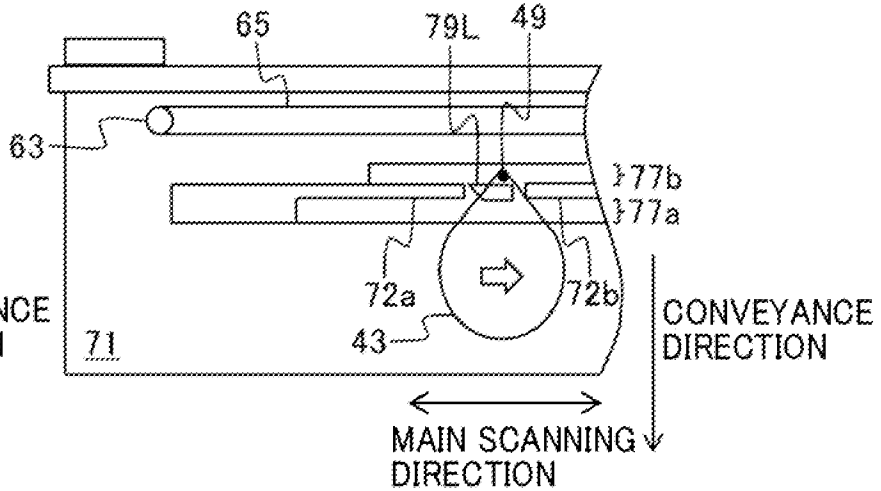
Figure 15C:
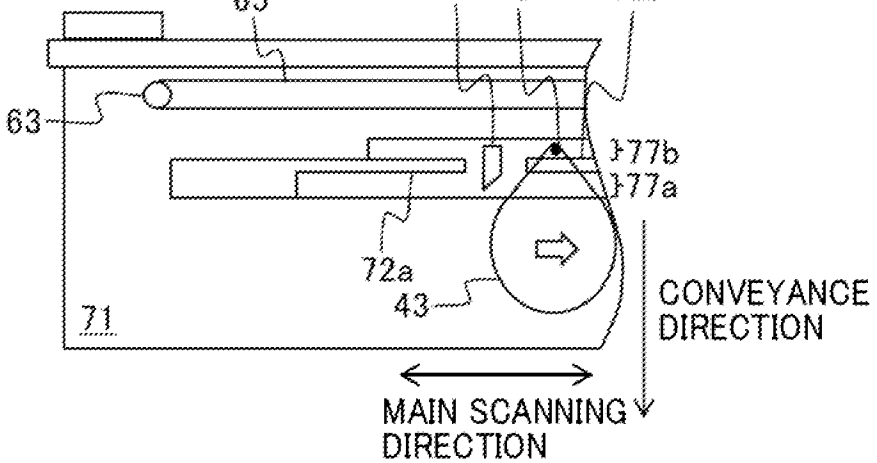

FIGS. 12A, 12B, 12C, and 12D are diagrams illustrating the movement of the cam 43 when the binding section 42 in the oblique binding posture on the end side is brought into the parallel binding posture on the center side. FIGS. 13A, 13B, 13C, and 13D are diagrams illustrating the movement of the cam 43 when the binding section 42 in the parallel binding posture on the center side is brought into the oblique binding posture on the end side. FIGS. 14A, 14B, and 14C are diagrams illustrating the movement of the cam 43 when the binding section 42 in the oblique binding posture on the end side is brought into the parallel binding posture on the end side. FIGS. 15A, 15B, and 15C are diagrams illustrating the movement of the cam 43 when the binding section 42 in the parallel binding posture at the end side is brought into the parallel binding posture at the center side. FIGS. 16A, 16B, and 16C are diagrams illustrating positions and orientations of binding staples 51 and S2 (i.e., a binding region) for binding a sheet bundle.

Figure 12A:
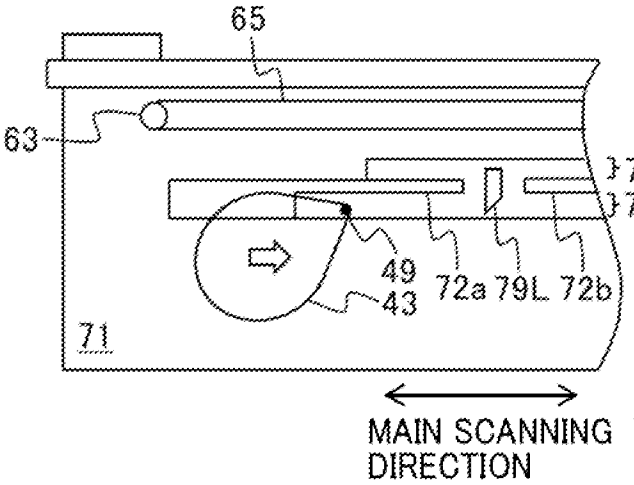
FIGS. 12A, 12B, 12C, and 12D are diagrams illustrating the movement of a cam when a binding section in an oblique binding posture on an end side is brought into a parallel binding posture on the center side.

As illustrated in FIG. 12A, when the guided portion 49 is positioned in the first passage 77*a* on the end side in the main scanning direction with respect to the movable wall 79L, the binding section 42 is in the oblique binding posture. When the binding section 42 binds the sheet bundle in this state, as illustrated in FIG. 16A, the lower left corner of the sheet bundle is bound by the binding staple 51 inclined with respect to the main scanning direction.

Figure 12B:
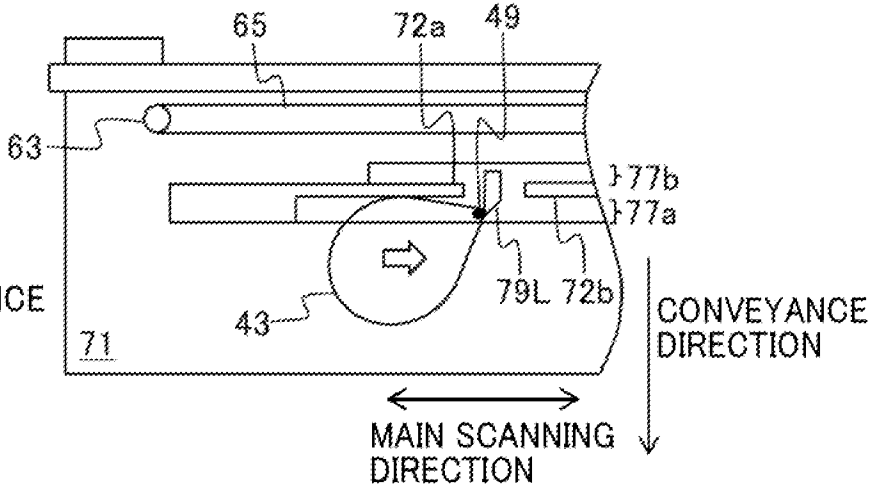

Next, when the controller 100 drives the moving motor 62 to move the staple binder 40 to the center side in the main scanning direction, as illustrated in FIG. 12B, the guided portion 49 moving the first passage 77*a* to the center side in the main scanning direction comes into contact with the movable wall 79L in the blocking posture. The guided portion 49 is guided from the first passage 77*a* to the second passage 77*b* along the side surface of the movable wall 79L that maintains the blocking posture. As a result, the binding section 42 changes its posture from the oblique binding posture to the parallel binding posture.

Figure 12C:
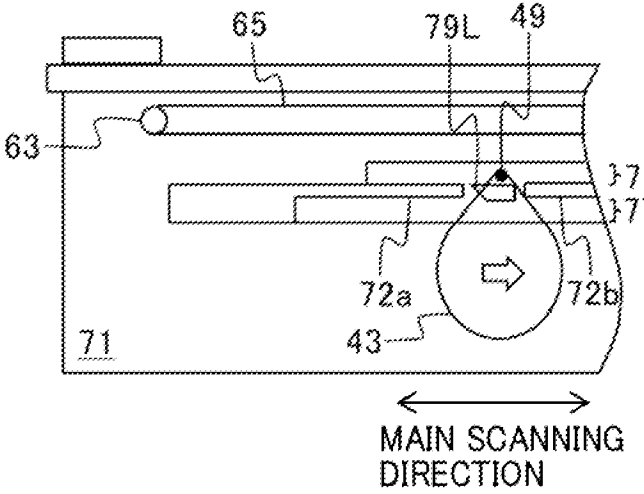
Figure 12D:
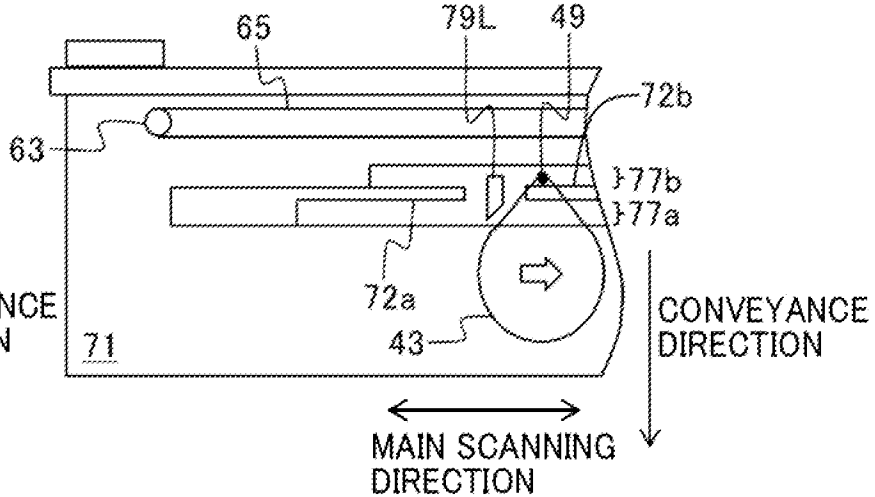

When the controller 100 further moves the staple binder 40 to the center side in the main scanning direction, as illustrated in FIG. 12C, the movable wall 79L pressed by the guided portion 49 rotates from the blocking posture to the open posture. Then, as illustrated in FIG. 12D, the guided portion 49 passes through the opened second passage 77*b* and moves to the center side from the movable wall 79L in the main scanning direction. When the binding section 42 binds a sheet bundle in this state, as illustrated in FIG. 16B, the central portion of the sheet bundle is bound by the binding staples S1 and S2 parallel to the main scanning direction. Note that the positions and the number of the binding staples S1 and S2 are not limited to the example of FIG. 16B.

Figure 13A:
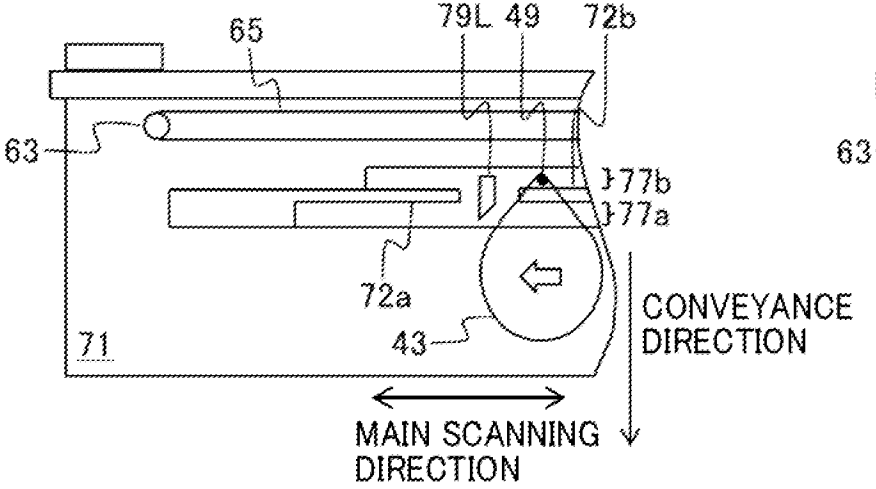
FIGS. 13A, 13B, 13C, and 13D are diagrams illustrating the movement of the cam when the binding section in the parallel binding posture on the center side is brought into the oblique binding posture on the end side.
Figure 13B:
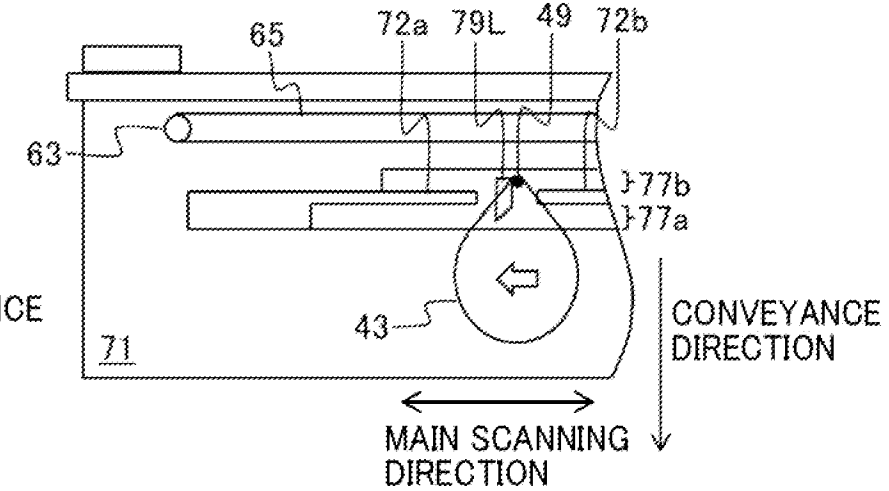
Figure 13C:
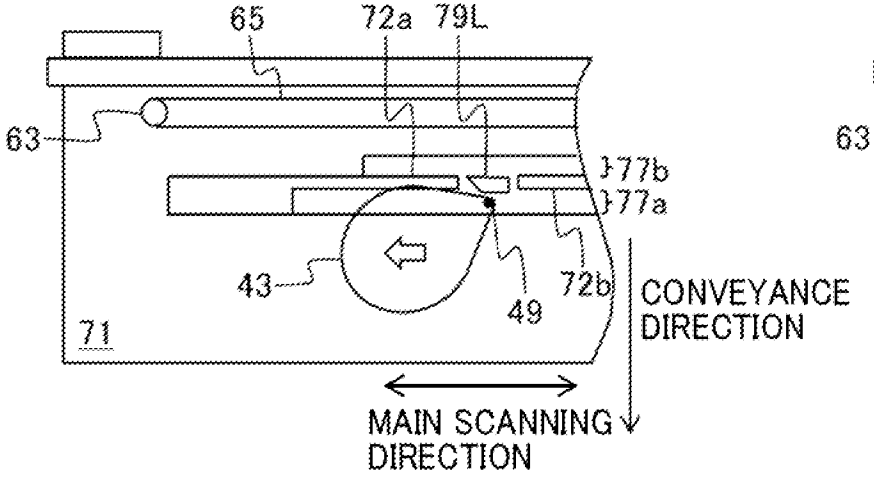
Figure 13D:
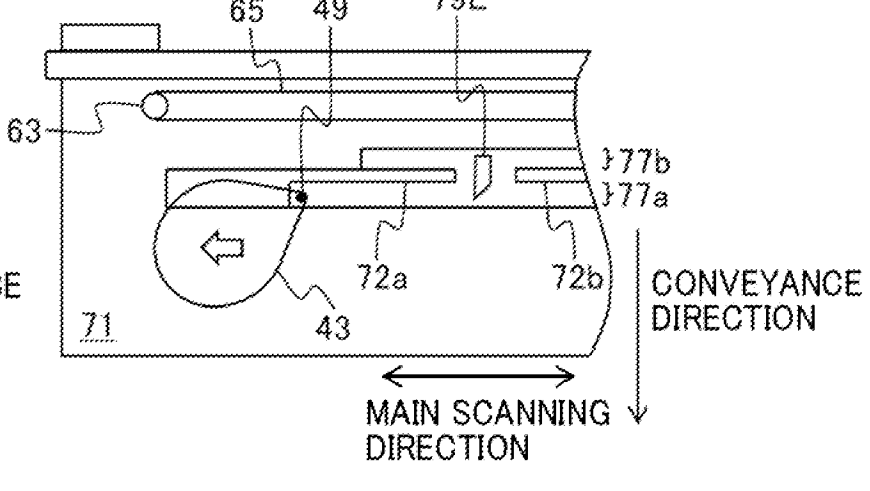

As illustrated in FIG. 13A, when the guided portion 49 located closer to the center in the main scanning direction than the movable wall 79L of the second passage 77*b* is moved to the end side in the main scanning direction, the guided portion 49 comes into contact with the movable wall 79L in the blocking posture as illustrated in FIG. 13B. Then, the guided portion 49 is guided from the second passage 77*b* to the first passage 77*a* along the side surface of the movable wall 79L maintaining the blocking posture. As a result, the binding section 42 changes its posture from the parallel binding posture to the oblique binding posture. When the controller 100 further moves the staple binder 40 to the end side in the main scanning direction, as illustrated in FIG. 13C, the movable wall 79L pressed by the guided portion 49 rotates from the blocking posture to the open posture. Then, as illustrated in FIG. 13D, the guided portion 49 moves to the end side in the main scanning direction from the movable wall 79L through the opened first passage 77*a*.

Further, as illustrated in FIGS. 14A and 14B, when the guided portion 49 positioned on the end side in the main scanning direction with respect to the movable wall 79L of the first passage 77*a* is moved to the center side in the main scanning direction, the guided portion 49 moves to the second passage 77*b*, and the movable wall 79L changes its posture to the open posture. As a result, the binding section 42 changes its posture from the oblique binding posture to the parallel binding posture. This operation is common to FIGS. 12A, 12B, and 12C. Then, when the controller 100 moves the staple binder 40 to the end side in the main scanning direction before the guided portion 49 passes through the movable wall 79L, as illustrated in FIG. 14C, the guided portion 49 moves along the second passage 77*b* to the end side in the main scanning direction. As a result, the staple binder 40 moves to the end side from the movable wall 79L in the main scanning direction while the binding section 42 remains in the parallel binding posture. When the binding section 42 binds the sheet bundle in this state, as illustrated in FIG. 16C, the lower left corner of the sheet bundle is bound by the binding staple S1 parallel to the main scanning direction.

Further, as illustrated in FIG. 15A, when the guided portion 49 positioned on the end side of the movable wall 79L of the second passage 77*b* in the main scanning direction is moved to the center side in the main scanning direction, the movable wall 79L pressed by the guided portion 49 rotates from the blocking posture to the open posture as illustrated in FIG. 15B. Then, as illustrated in FIG. 15C, the guided portion 49 passes through the opened second passage 77*b* and moves to the center side in the main scanning direction from the movable wall 79L. As a result, the staple binder 40 reaches the center side in the main scanning direction from the movable wall 79L while the binding section 42 remains in the parallel binding posture.

Note that the movements of FIGS. 12A to 15C can be applied not only between the guided portion 49 and the movable wall 79L but also between the guided portion 49 and the movable wall 79R. As an example, when the binding section 42 binds the sheet bundle after the guided portion 49 and the movable wall 79R move by horizontally reversing FIGS. 13A to 13D, the lower right corner of the sheet bundle is bound by the binding staple S2 inclined with respect to the main scanning direction as illustrated in FIG. 16A. As another example, when the binding section 42 binds the sheet bundle after the guided portion 49 and the movable wall 79R move by horizontally reversing FIGS. 14A to 14C, the lower right corner of the sheet bundle is bound by the binding staple S2 parallel to the main scanning direction as illustrated in FIG. 16C.

Figure 17A:
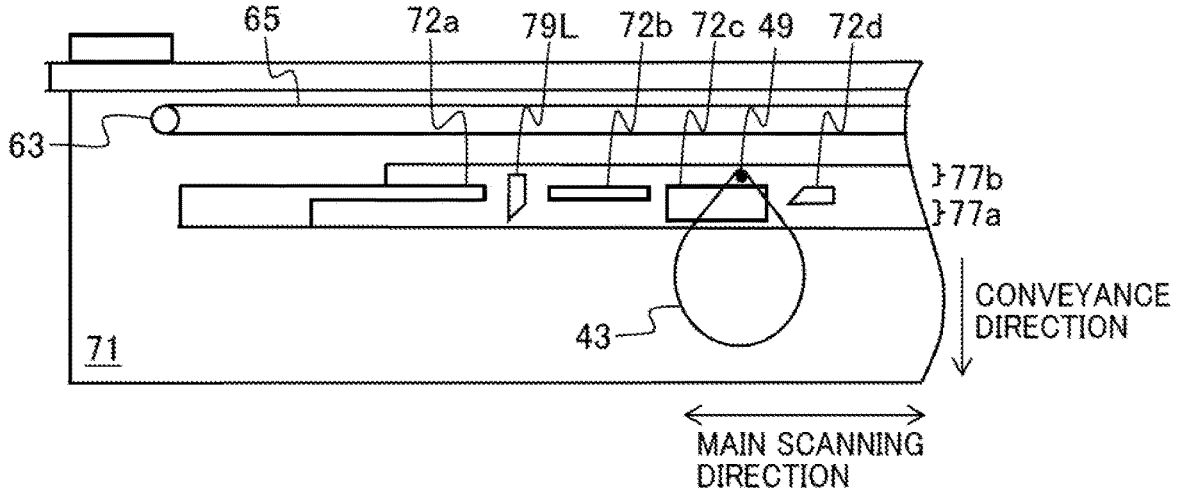
FIGS. 17A, 17C, and 17C are diagrams illustrating the function of a guide wall.
Figure 17B:
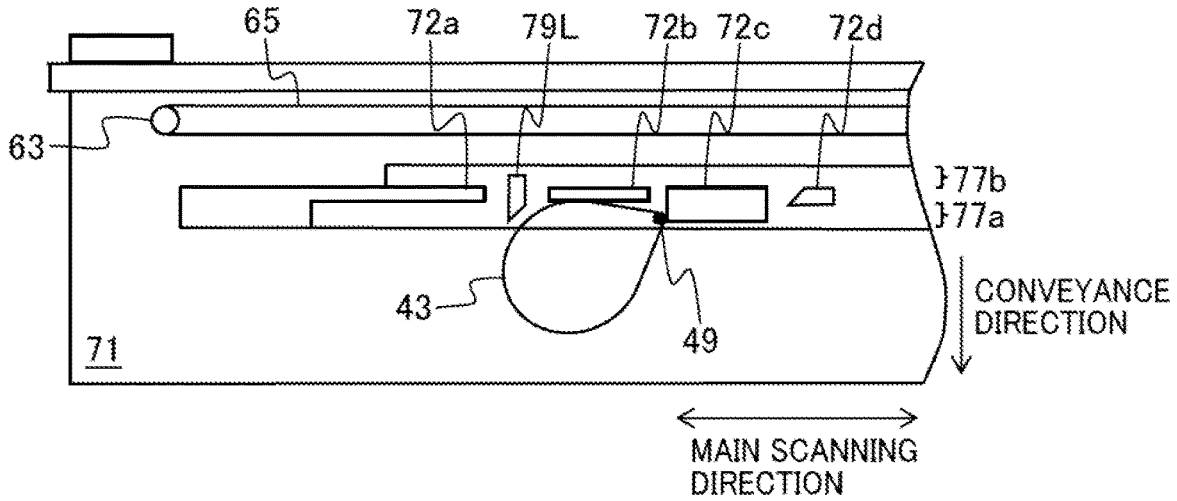
Figure 17C:
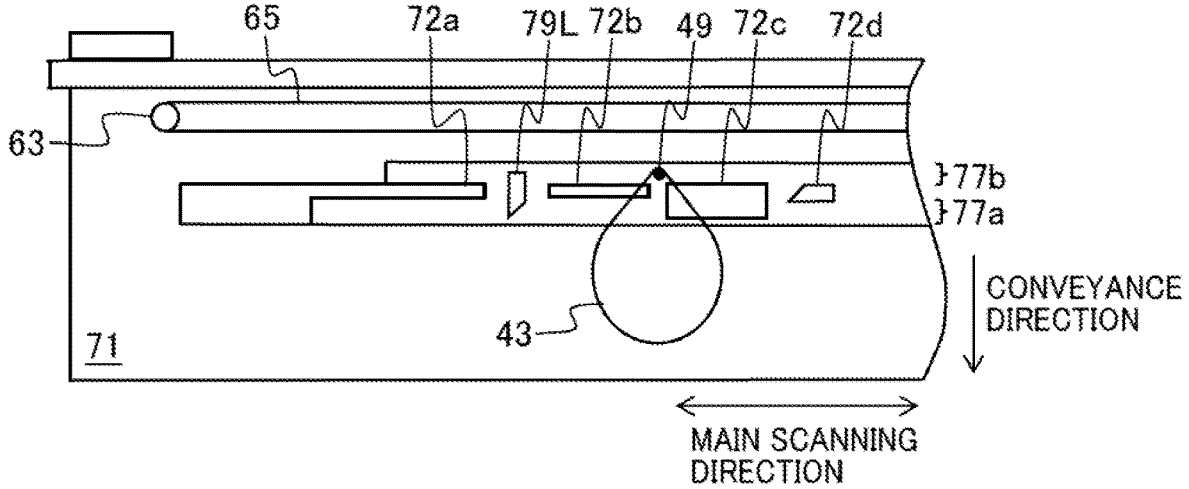

FIGS. 17A, 17C, and 17C are diagrams illustrating the function of the guide wall 72*c*. As illustrated in FIGS. 17A, 17C, and 17C, the guide wall 72*c* is disposed closer to the center in the main scanning direction than the movable walls 79L and 79R. The length of the guide wall 72*c* in the conveyance direction is longer than the length of each of the other guide walls 72*a*, 72*b*, 72*d*, and 72*e*. The guide wall 72*c* blocks the first passage 77*a* and opens the second passage 77*b*. The first passage 77*a* and the second passage 77*b* communicate with each other at both ends of the guide wall 72*c* in the main scanning direction.

As illustrated in FIG. 17A, the guide wall 72*c* allows the guided portion 49 to pass through the second passage 77*b*. As illustrated in FIG. 17B, the guide wall 72*c* prevents the guided portion 49 from passing through the first passage 77*a*. Further, as illustrated in FIG. 17C, the guided portion 49 moving in the first passage 77*a* comes into contact with the guide wall 72*c*, and thus the guide wall 72*c* guides the guided portion 49 to the second passage 77*b*.

According to the above-described embodiment, for example, the following operational effects can be obtained.

In a case of a typical configuration in which a binder largely rotates, a large space is needed to change the posture of the binder. As a result, a medium processing apparatus increases in size.

According to the embodiment described above, the posture of the staple binder 40 (the binding section 42) can be switched by allowing the movable walls 79L and 79R to rotate toward one side and restricting the movable walls 79L and 79R from rotating toward the other side. Thus, the posture of the staple binder 40 can be changed with a small and simple configuration. When the guided portion 49 passes through the movable walls 79L and 79R, the movable walls 79L and 79R are immediately changed to the blocking posture by the coil springs 76L and 76R. Thus, the processing time can be reduced when the posture of the staple binder 40 is continuously changed.

Further, according to the above-described embodiment, the bosses 73L and 73R, the restriction walls 74L and 74R, the movable members 75L and 75R, and the coil springs 76L and 76R are disposed at two positions separated from each other in the main scanning direction. Thus, the oblique binding and the parallel binding can be performed on both sides in the main scanning direction.

Further, according to the above-described embodiment, the transmission mechanism 44 is accommodated inside the internal gear 50. Thus, the size of the mechanism for changing the posture of the binding section 42 can be reduced. In addition, the transmission mechanism 44 is interposed instead of directly transmitting the rotation of the cam 43 to the binding section 42. Thus, the rotation amount of the cam 43 can be amplified or reduced and transmitted to the binding section 42.

Further, according to the above-described embodiment, when the binder 40 passes between the movable members 75L and 75R, the binding section 42 can be forcibly changed to the parallel binding posture by the guide wall 72*c*. Accordingly, even in a case where the oblique binding posture is maintained due to insufficient rotation of the cam 43 when passing through the movable walls 79L and 79R, the binding section 42 can be switched to the parallel binding posture.

Now, a description is given of a second embodiment of the present disclosure.

Figure 18A:
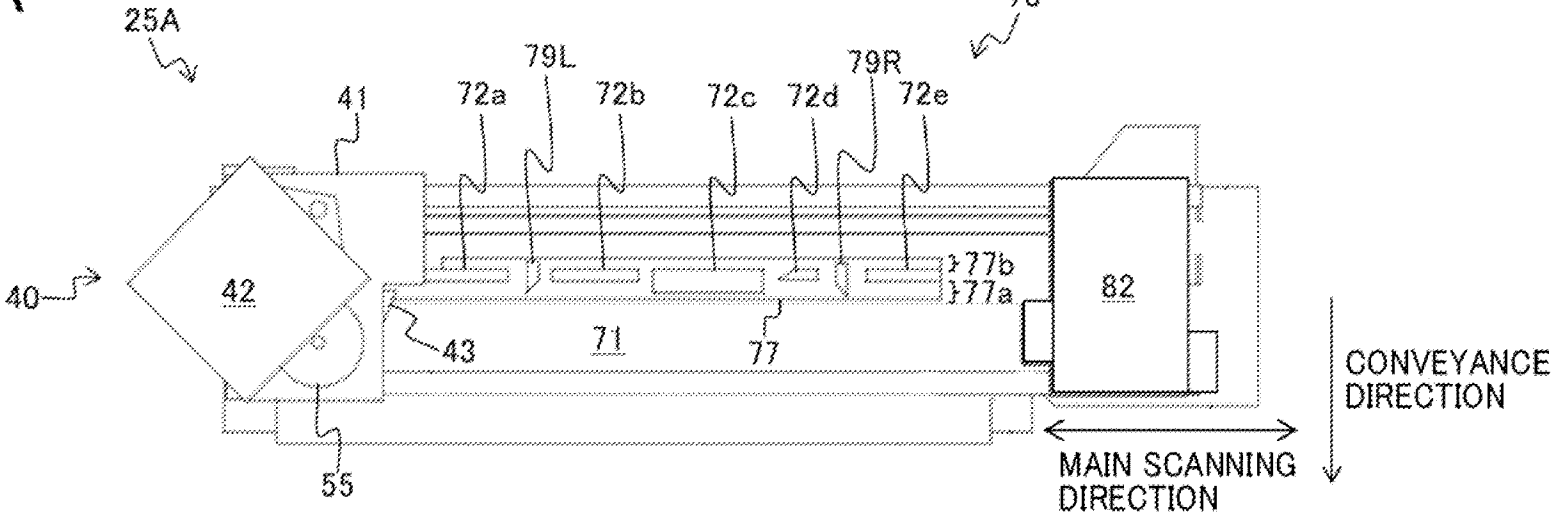
FIGS. 18A and 18B are plan views of an end binding mechanism according to a second embodiment of the present disclosure.
Figure 18B:
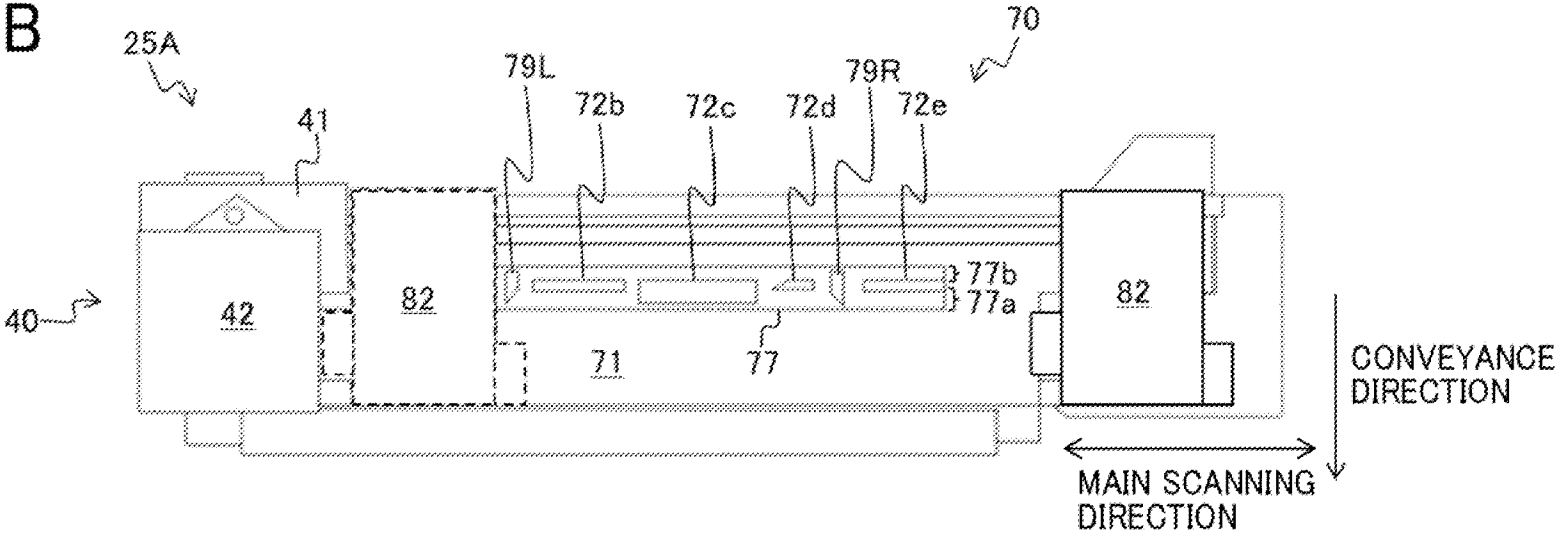

FIGS. 18A and 18B are plan views of an end binding mechanism 25A according to the second embodiment. Note that the detailed description of the conveyance deviation correcting process common to the first embodiment is omitted and the description of the second embodiment different from the first embodiment is given. The end binding mechanism 25A according to the second embodiment is different from the end binding mechanism 25 of the first embodiment in that the end binding mechanism 25A further includes a crimp binder 82 serving as a second binder. The crimp binder 82 executes so-called "crimp binding" of pressing and deforming a sheet bundle in the thickness direction to bind the sheet bundle. The configuration of the crimp binder 82 may be an already-known configuration.

The staple binder 40 and the crimp binder 82 are disposed at positions separated from each other in the main scanning direction. The mover 60 moves the staple binder 40 and the crimp binder 82 independently of each other in the main scanning direction. The standby position of the staple binder 40 is at an end on one side (left side in the example of FIGS. 18A and 18B) in the main scanning direction, and the standby position of the crimp binder 82 is at an end on the other side (right side in the example of FIGS. 18A and 18B) in the main scanning direction.

As illustrated in FIG. 18B, the staple binder 40 sets the binding section 42 to the parallel binding posture while waiting at the waiting position (a state in which the sheet bundle is not bound). At this time, the end portion (FIG. 18B) on the center side in the main scanning direction of the staple binder 40 in the parallel binding posture is positioned closer to the end side in the main scanning direction than in the oblique binding posture (FIG. 18A). In other words, the staple binder 40 in the parallel binding posture is caused to stand by at the standby position, thus increasing the movement range of the crimp binder 82 in the main scanning direction as compared with the case where the staple binder 40 in the oblique binding posture is caused to stand by at the standby position.

According to the second embodiment, the range in the main scanning direction in which the crimp binding can be performed by the crimp binder 82 can be increased. A specific example of the combination of the first binder and the second binder is not limited to the example of FIGS. 18A and 18B. As another example, both the first binder and the second binder may be the staple binder 40.

Third Embodiment

FIGS. 19A, 19B, 19C, and 19D are diagrams illustrating the motion of the movable wall 83L according to the third embodiment. Note that the detailed description of the conveyance deviation correcting process common to the first embodiment is omitted and the description of the second embodiment different from the first embodiment is given. The movable wall 83L according to the third embodiment is different from the movable wall 79L that rotates around the rotation axis extending in the thickness direction of the sheet P in that the movable wall 79L slides in the conveyance direction (another example of the movement of the movable wall 79L).

As illustrated in FIGS. 19A, 19B, 19C, and 19D, in the side surface of the movable wall 83L facing the center side (right side in FIGS. 19A, 19B, 19C, and 19D) in the main scanning direction, a portion positioned in the first passage 77*a* in the blocking posture is inclined with respect to the main scanning direction, and the other portion is orthogonal to the main scanning direction. In the side surface of the movable wall 83L facing the end side in the main scanning direction (left side in FIGS. 19A, 19B, 19C, and 19D), a portion positioned in the second passage 77*b* in the blocking posture is inclined with respect to the main scanning direction, and the other portion is orthogonal to the main scanning direction. The movable wall 83R having a shape obtained by horizontally inverting the movable wall 83L is provided at a position spaced apart from the movable wall 83L in the main scanning direction.

Figure 19A:
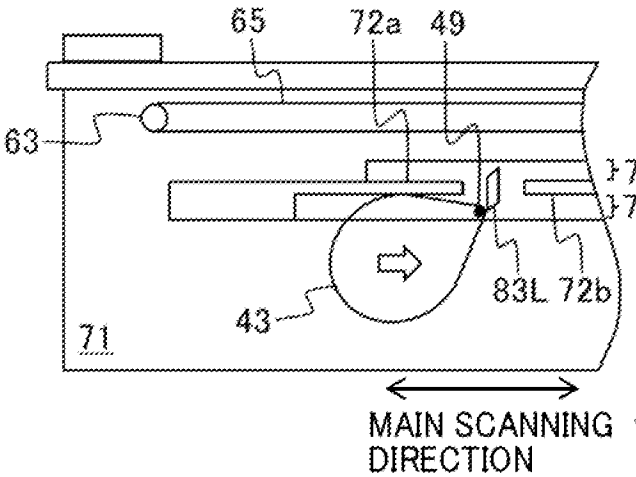
FIGS. 19A, 19B, 19C, and 19D are diagrams illustrating the motion of a movable wall according to a third embodiment of the present disclosure.
Figure 19B:
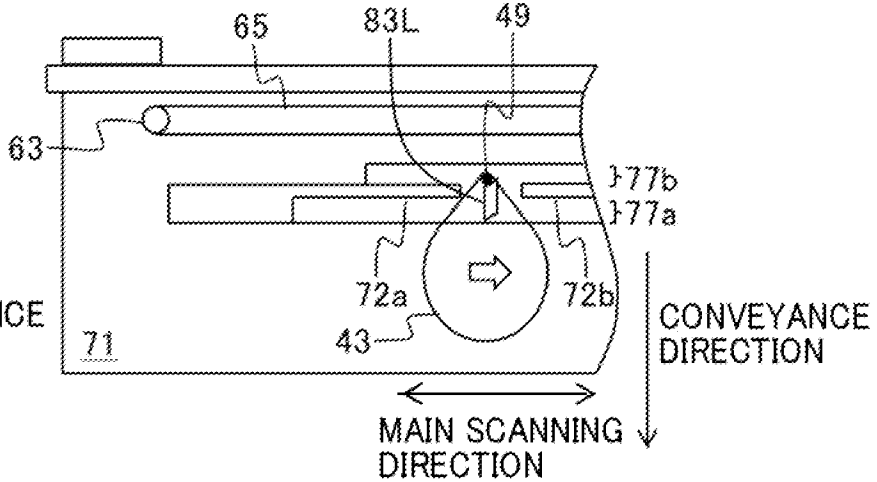

As illustrated in FIG. 19A, when the guided portion 49 moving toward the center of the first passage 77*a* in the main scanning direction comes into contact with the movable wall 83L in the blocking posture, the movable wall 83L maintains the blocking posture and guides the guided portion 49 to the second passage 77*b*. As illustrated in FIG. 19B, when the guided portion 49 that moves the second passage 77*b* toward the center in the main scanning direction comes into contact with the movable wall 83L in the blocking posture, the movable wall 83L slides toward the downstream side in the conveyance direction and changes its posture to the open posture to open the second passage 77*b*. As a result, the guided portion 49 can move in the second passage 77*b* toward the center in the main scanning direction from the movable wall 83L.

Figure 19C:
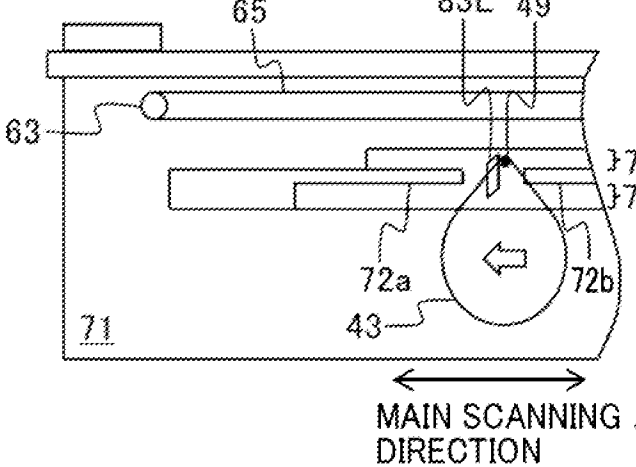
Figure 19D:
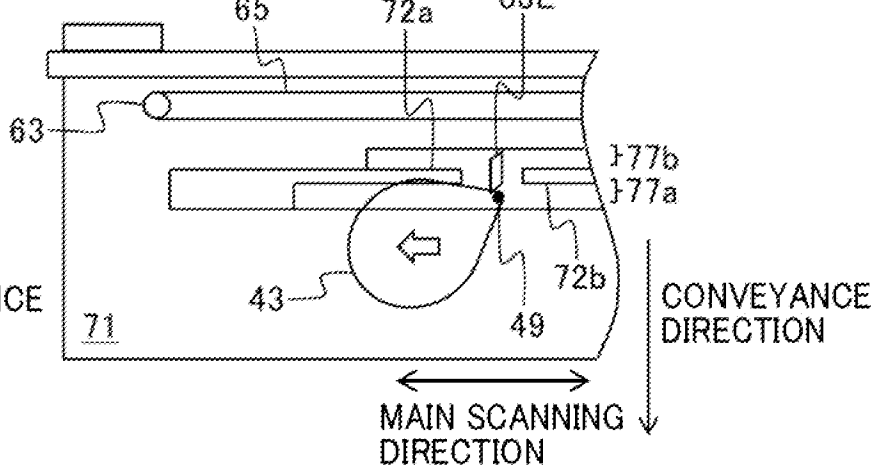

As illustrated in FIG. 19C, when the guided portion 49 moving on the second passage 77*b* to the end side in the main scanning direction comes into contact with the movable wall 83L in the blocking posture, the movable wall 83L maintains the blocking posture and guides the guided portion 49 to the first passage 77*a*. As illustrated in FIG. 19D, when the guided portion 49 that moves the first passage 77*a* to the end side in the main scanning direction comes into contact with the movable wall 83L in the blocking posture, the movable wall 83L slides to the upstream side in the conveyance direction and changes the posture to the open posture to open the first passage 77*a*. Accordingly, the guided portion 49 can move in the first passage 77*a* to the end side in the main scanning direction with respect to the movable wall 83L.

Fourth Embodiment

FIGS. 20A, 20B, 20C, and 20D are diagrams illustrating the motion of a movable wall 84L according to the fourth embodiment. Note that the detailed description of the conveyance deviation correcting process common to the first embodiment is omitted and the description of the second embodiment different from the first embodiment is given. The movable wall 84L according to the fourth exemplary embodiment is different from the movable wall 79L that rotates around the rotation axis extending in the thickness direction of the sheet P in that the movable wall 84L includes a first roller 85*a* and a second roller 85*b* that rotate around the rotation axes extending in the conveyance direction (another example of the movement of the movable wall). The movable wall 84R having a shape obtained by horizontally inverting the movable wall 84L is provided at a position spaced apart from the movable wall 84L in the main scanning direction.

Figure 20A:
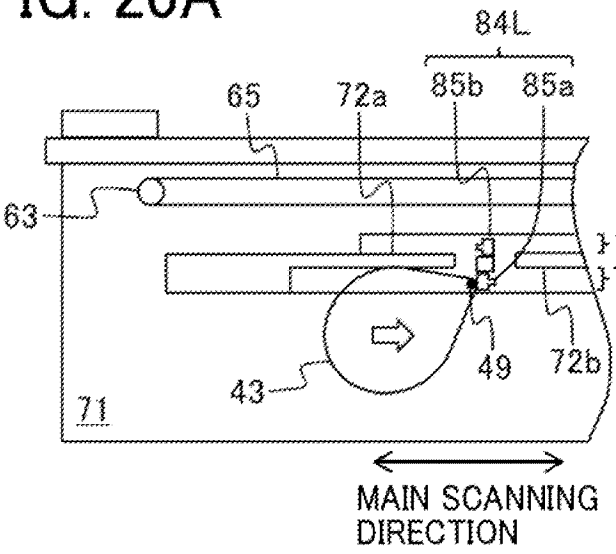
FIGS. 20A, 20B, 20C, and 20D are diagrams illustrating the motion of a movable wall according to a fourth embodiment of the present disclosure.
Figure 20B:
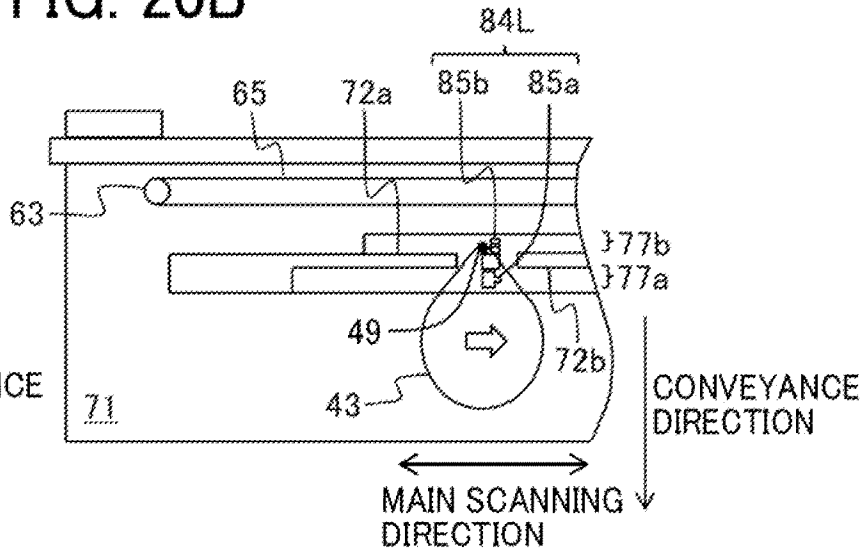
Figure 20C:
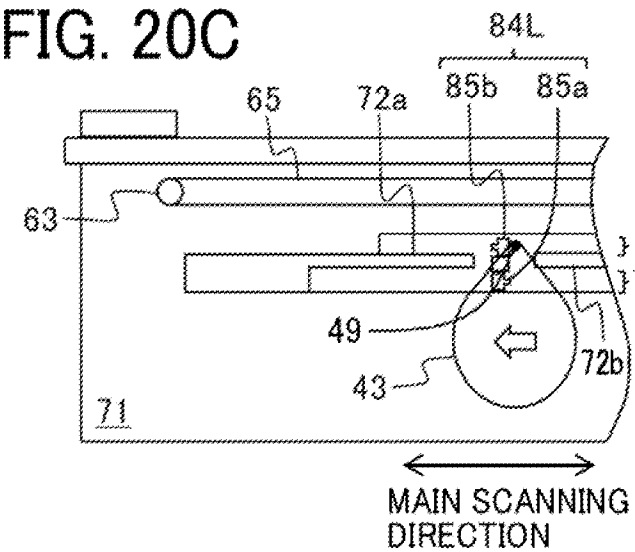
Figure 20D:
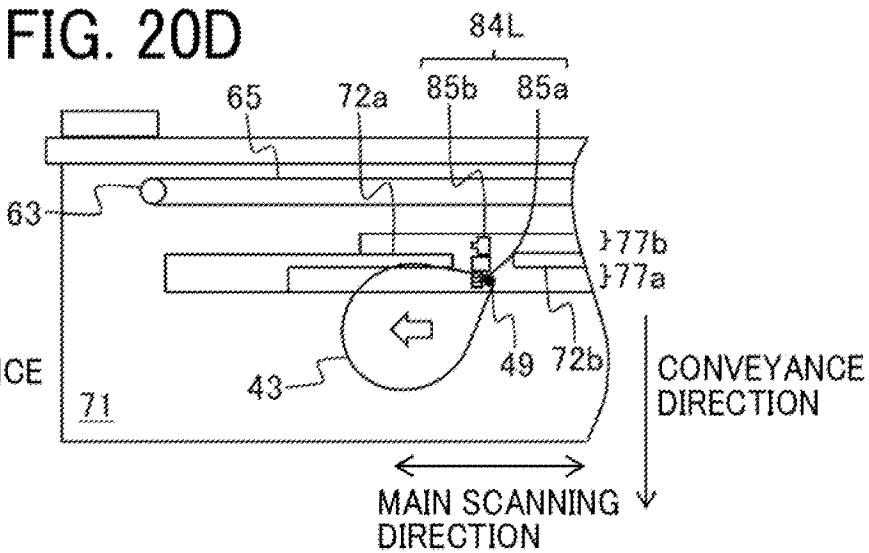

The first roller 85*a* is disposed in the first passage 77*a*. As illustrated in FIG. 20A, when the guided portion 49 moving in the first passage 77*a* toward the center in the main scanning direction comes into contact with the first roller 85*a*, the first roller 85*a* maintains the blocking posture and guides the guided portion 49 to the second passage 77*b*. On the other hand, as illustrated in FIG. 20D, when the guided portion 49 moving on the first passage 77*a* toward the end side in the main scanning direction comes into contact with the first roller 85*a*, the first roller 85*a* rotates around the rotation axis extending in the conveyance direction and changes its posture to the open posture. As a result, the guided portion 49 can move to the end side in the main scanning direction from the movable wall 84L in the opened first passage 77*a*.

The second roller 85*b* is disposed in the second passage 77*b*. As illustrated in FIG. 20B, when the guided portion 49 that moves the second passage 77*b* toward the center side in the main scanning direction comes into contact with the second roller 85*b*, the second roller 85*b* rotates around the rotation axis extending in the conveyance direction and changes its posture to the open posture. As a result, the guided portion 49 can move in the opened second passage 77*b* toward the center side in the main scanning direction from the movable wall 84L. On the other hand, as illustrated in FIG. 20C, when the guided portion 49 moving on the second passage 77*b* toward the end side in the main scanning direction comes into contact with the second roller 85*b*, the second roller 85*b* maintains the blocking posture and guides the guided portion 49 to the first passage 77*a*.

The control method described above may be implemented by, for example, a program. For example, the control method may be executed by causing an arithmetic device, a storage device, an input device, an output device, and a control device to operate in cooperation with each other based on a program. The program may be written in, for example, a storage device or a storage medium and distributed, or may be distributed through, for example, an electric communication line.

Embodiments of the present disclosure are not limited to the above-described embodiments, and numerous additional modifications and variations are possible in light of the teachings within the technical scope of the appended claims. It is therefore to be understood that the disclosure of this patent specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

Now, a description is given of some aspects of the present disclosure.

Initially, a description is given of a first aspect.

A medium processing apparatus includes: a conveyor to convey a medium in a conveyance direction; a tray to support a plurality of media conveyed by the conveyor; a binder to bind the plurality of media supported on the tray; a mover to move the binder in a main scanning direction orthogonal to the conveyance direction along a surface of the plurality of media supported on the tray; and a switcher to guide a guided portion of the binder to switch between an oblique binding posture in which a longitudinal direction of a binding region bound by the binder is inclined with respect to the main scanning direction and a parallel binding posture in which the longitudinal direction of the binding region is oriented in the main scanning direction. The switcher includes: a first passage extending in the main scanning direction, the guided portion to enter the first passage when the binder is in the oblique binding posture; a second passage extending in the main scanning direction on an upstream side from the first passage in the conveyance direction, the guided portion to enter the second passage when the binder is in the parallel binding posture; a movable wall to move between a blocking posture in which each of the first passage and the second passage is blocked by the movable wall and the first passage and the second passage communicate with each other and an open posture in which at least one of the first passage or the second passage is open; and an urging member to urge the movable wall toward the blocking posture. The movable wall is to: guide the guided portion to the second passage while maintaining the blocking posture, when the guided portion moving along the first passage from an end side to a center side in the main scanning direction comes into contact with the movable wall; move to the open posture and cause the guided portion to pass when the guided portion moving along the second passage from the end side to the center side in the main scanning direction comes into contact with the movable wall; guide the guided portion to the first passage while maintaining the blocking posture, when the guided portion moving along the second passage from the center side to the end side in the main scanning direction comes into contact with the movable wall; and move to the open posture and cause the guided portion to pass through when the guided portion moving along the first passage from the center side to the end side in the main scanning direction comes into contact with the movable wall.

Now, a description is given of a second aspect.

The medium processing apparatus according to the first aspect, wherein the movable wall and the urging member are disposed at two positions away from each other in the main scanning direction.

Now, a description is given of a third aspect.

In the medium processing apparatus according to the first or second aspect, the binder includes: a binding section to rotate around a first rotation axis between the parallel binding posture and the oblique binding posture, the first rotation axis extending in a thickness direction of the medium supported on the tray; a cam including the guided portion and an internal gear, the cam to rotate around a second rotation axis extending in the thickness direction; and a transmission mechanism disposed on an inner side of the internal gear, the transmission mechanism to transmit rotation of the cam to the binding section.

Now, a description is given of a fourth aspect.

In the medium processing apparatus according to the third aspect, the binder includes a base rotatably supporting the binding section on an upper surface of the base and rotatably supporting the cam on a lower surface of the base. The binding section includes an external gear. The transmission mechanism includes: a first gear on a lower surface side of the base, the first gear meshing with the internal gear to rotate; a second gear on a lower surface side of the base, the second gear meshing with the first gear to rotate; a third gear on an upper surface side of the base, the third gear meshing with the external gear to rotate; and a rotation shaft passing through the base in the thickness direction to rotate together with the second gear and the third gear.

Now, a description is given of a fifth aspect.

In the medium processing apparatus according to any one of the first to fourth aspects, the switcher includes a guide wall at a position closer to a center of the first passage in the main scanning direction than the movable wall is. The guide wall is to block the first passage and guide the guided portion placed in the first passage to the second passage.

Now, a description is given of a sixth aspect.

In the medium processing apparatus according to any one of the first to firth aspects, the binder includes a first binder and a second binder at positions away from the binder in the main scanning direction. The first binder and the second binder are to be moved independently of each other by the mover.

When the first binder is moved to an end in the main scanning direction by the mover, one end of the first binder, which is closer to the center side in the main scanning direction, in the parallel binding posture is at a position closer to the end side in the main scanning direction than in the oblique binding posture.

Now, a description is given of a seventh aspect.

In the medium processing apparatus according to the sixth aspect, the mover is to: move the first binder in the oblique binding posture, which is at a position closer to an end in the main scanning direction than the movable wall is, toward the center side in the main scanning direction to change a posture of the first binder to the parallel binding posture; and move the first binder to the end side in the main scanning direction before the guided portion passes the movable wall in the open posture, to change the posture of the first binder to the parallel binding posture at a position closer to the end in the main scanning direction than the movable wall is.

Now, a description is given of an eighth aspect.

In the medium processing apparatus according to the sixth aspect, the first binder is a staple binder to bind, with a staple, the plurality of media supported on the tray, and the second binder is a crimp binder to press and deform the plurality of media supported on the tray to bind the plurality of media.

Now, a description is given of a ninth aspect.

An image forming system includes: an image forming apparatus to form an image on a medium; the medium processing apparatus according to any one of the first to eighth aspects, to crimp and bind the plurality of media on which the images are formed by the image forming apparatus.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. A medium processing apparatus, comprising:

a conveyor to convey a medium in a conveyance direction;

a tray to support a plurality of media conveyed by the conveyor;

a binder to bind the plurality of media supported on the tray;

a mover to move the binder in a main scanning direction orthogonal to the conveyance direction along a surface of the plurality of media supported on the tray; and a switcher to guide a guided portion of the binder to switch between an oblique binding posture in which a longitudinal direction of a binding region bound by the binder is inclined with respect to the main scanning direction and a parallel binding posture in which the longitudinal direction of the binding region is oriented in the main scanning direction, the switcher including:

a first passage extending in the main scanning direction, the guided portion to enter the first passage when the binder is in the oblique binding posture;

a second passage extending in the main scanning direction on an upstream side from the first passage in the conveyance direction, the guided portion to enter the second passage when the binder is in the parallel binding posture;

a movable wall to move between a blocking posture in which each of the first passage and the second passage is blocked by the movable wall and the first passage and the second passage communicate with each other and an open posture in which at least one of the first passage or the second passage is open; and an urging member to urge the movable wall toward the blocking posture, the movable wall to:

guide the guided portion to the second passage while maintaining the blocking posture, when the guided portion moving along the first passage from an end side to a center side in the main scanning direction comes into contact with the movable wall, move to the open posture and cause the guided portion to pass when the guided portion moving along the second passage from the end side to the center side in the main scanning direction comes into contact with the movable wall;

guide the guided portion to the first passage while maintaining the blocking posture, when the guided portion moving along the second passage from the center side to the end side in the main scanning direction comes into contact with the movable wall; and move to the open posture and cause the guided portion to pass when the guided portion moving along the first passage from the center side to the end side in the main scanning direction comes into contact with the movable wall.

2. The medium processing apparatus according to claim 1, wherein the movable wall and the urging member are disposed at two positions away from each other in the main scanning direction.

3. The medium processing apparatus according to claim 1, wherein the binder includes:

a binding section to rotate around a first rotation axis between the parallel binding posture and the oblique binding posture, the first rotation axis extending in a thickness direction of the medium supported on the tray;

a cam including the guided portion and an internal gear, the cam to rotate around a second rotation axis extending in the thickness direction; and a transmission mechanism disposed on an inner side of the internal gear, the transmission mechanism to transmit rotation of the cam to the binding section.

4. The medium processing apparatus according to claim 3, wherein the binder includes a base rotatably supporting the binding section on an upper surface of the base and rotatably supporting the cam on a lower surface of the base, wherein the binding section includes an external gear, and wherein the transmission mechanism includes:

a first gear on a lower surface side of the base, the first gear meshing with the internal gear to rotate;

a second gear on a lower surface side of the base, the second gear meshing with the first gear to rotate;

a third gear on an upper surface side of the base, the third gear meshing with the external gear to rotate; and a rotation shaft passing through the base in the thickness direction to rotate together with the second gear and the third gear.

5. The medium processing apparatus according to claim 1, wherein the switcher includes a guide wall at a position closer to a center of the first passage in the main scanning direction than the movable wall is, the guide wall to block the first passage and guide the guided portion placed in the first passage to the second passage.

6. The medium processing apparatus according to claim 1, further comprising another binder at a position away from the binder in the main scanning direction, said another binder to be moved independently of the binder by the mover, wherein when the binder is moved to an end in the main scanning direction by the mover, one end of the binder, which is closer to the center side in the main scanning direction, in the parallel binding posture is at a position closer to the end side in the main scanning direction than in the oblique binding posture.

7. The medium processing apparatus according to claim 6, wherein the mover is to:

move the binder in the oblique binding posture, which is at a position closer to an end in the main scanning direction than the movable wall is, toward the center side in the main scanning direction to change a posture of the binder to the parallel binding posture; and move the binder to the end side in the main scanning direction before the guided portion passes the movable wall in the open posture, to change the posture of the binder to the parallel binding posture at a position closer to the end in the main scanning direction than the movable wall is.

8. The medium processing apparatus according to claim 6, wherein the binder is a staple binder that binds the plurality of media supported on the tray with a staple, and wherein said another binder is a crimp binder to press and deform the plurality of media supported on the tray to bind the plurality of media.

9. An image forming system, comprising:

an image forming apparatus to form images on a plurality of media; and the medium processing apparatus according to claim 1, to crimp and bind the plurality of media on which the images are formed by the image forming apparatus.

* * * * *